US012504247B2

(12) United States Patent
Hamersley

(10) Patent No.: US 12,504,247 B2
(45) Date of Patent: Dec. 23, 2025

(54) MODULAR FIREARM LOWER RECEIVER ASSEMBLY FOR RAPID CONVERSION OF AR-15 TYPE FIREARMS TO A BULLPUP CONFIGURATION AND METHOD OF ASSEMBLY THEREOF

(71) Applicant: Michael C. Hamersley, El Dorado Hills, CA (US)

(72) Inventor: Michael C. Hamersley, El Dorado Hills, CA (US)

( * ) Notice: Subject to any disclaimer, the term of this patent is extended or adjusted under 35 U.S.C. 154(b) by 0 days.

(21) Appl. No.: 18/766,502

(22) Filed: Jul. 8, 2024

(65) Prior Publication Data

US 2025/0035394 A1 Jan. 30, 2025

Related U.S. Application Data

(60) Provisional application No. 63/525,365, filed on Jul. 6, 2023.

(51) Int. Cl.
*F41A 11/02* (2006.01)
*F41A 3/66* (2006.01)

(52) U.S. Cl.
CPC ..... *F41A 11/02* (2013.01); *F41A 3/66* (2013.01)

(58) Field of Classification Search
None
See application file for complete search history.

(56) References Cited

U.S. PATENT DOCUMENTS 7,356,958 B2 * 4/2008 Weir ..... F41C 23/12 42/42.02
11,644,260 B1 * 5/2023 Douvier ..... F41A 11/02 42/75.01

* cited by examiner

*Primary Examiner* — Reginald S Tillman, Jr.
(74) *Attorney, Agent, or Firm* — Jackson Walker LLP; Christopher J. Rourk

(57) ABSTRACT

The present invention is a modular firearm lower receiver assembly for rapid conversion of conventionally configured modular firearms to a bullpup configuration and the method of assembly thereof. The preferred embodiment of the present invention is intended for designed use with modular firearms in the family AR-15 Type Firearms and enables a rapid conversion of a wide array of conventionally configured AR-15 Type Firearm to and a bullpup configuration. Such rapid conversion, which can generally be performed in a matter of seconds without any tools, is accomplished by decoupling and detaching the two captured receiver pins on the lower receiver of the conventionally configured AR-15 Type Firearm, removing the upper receiver assembly therefrom, and recoupling such upper receiver assembly to the present invention using two identically located receiver pins on the present invention. The present invention is universally applicable to AR-15 Type firearms of several different calibers and having an array of differences with respect to the lower receiver, upper receiver, handguard, bolt carrier group, or gas systems employed therein.

18 Claims, 26 Drawing Sheets

Bullpup Stock and Short Buffer Recoil System

SBR Configuration PE1 Mounted to Conventional Upper Receiver Assembly Having Delta Ring Handguard SBR Configuration PE1 Mounted to Conventional Upper Receiver Assembly Having Quadrail Handguard USER-INSTALLED "AR-15 BULLPUP CONVERSION KITS"/"AR-15 BULLPUP CHASIS" KNOWN IN THE ART

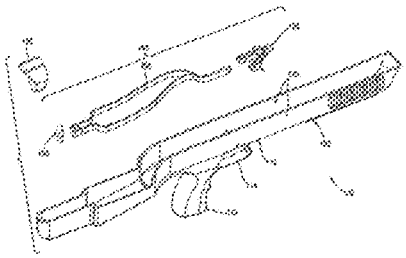

PATENT APPLICATION US2014/0075812 A1
AR-15 TYPE BULLPUP CONVERTED FIREARM AND METHOD OF ASSEMBLY THEREOF
JOHNSON/ (Mar. 20, 2014)

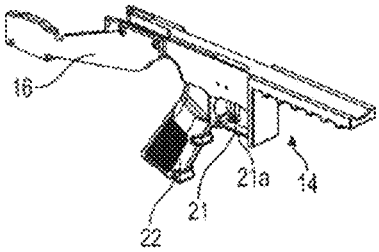

PATENT GRANT US11,644,260 B1
METHOD AND APPARATUS FOR CONVERTING AN AR-15 FIREARM INTO A BULLPUP CONFIGURATION DOUVIER. (Mar. 9, 2023)

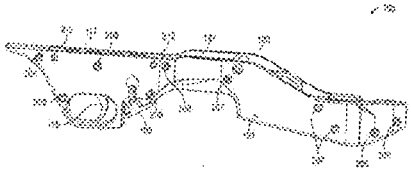

PATENT APPLICATION US2024/0077270 A1
TRIGGER RELOCATION ASSEMBLY FOR MODERN SPORTING RIFLE
POPP ET AL. (Mar. 7, 2024)

FIG. 39
(Prior Art)

MODULAR FIREARM LOWER RECEIVER ASSEMBLY FOR RAPID CONVERSION OF AR-15 TYPE FIREARMS TO A BULLPUP CONFIGURATION AND METHOD OF ASSEMBLY THEREOF

RELATED APPLICATIONS

The present application claims the benefit of and priority to U.S. Provisional Patent Application No. 63/525,365, filed on Jul. 6, 2023, the disclosure and content of which is hereby incorporated by reference for all purposes as if set forth herein in its entirety.

TECHNICAL FIELD

This disclosure is a bullpup-configured lower receiver assembly which relates to firearms, more particularly, to modular firearms and modern sporting rifles generally included in the family of firearms commonly referred to and defined herein as AR-15 type firearms (AR-15 Type Firearms).

BACKGROUND OF INVENTION

Firearms are weapons generally designed to expel a projectile(s) by the action of an explosive and are well known in the art and for military and private use. The Gun Control Act of 1968 (GCA) defines the term "firearm" to include a "frame" or "receiver" that is the primary structural component of the firearm in which the fire control unit (FCU) is housed or attached. See 18 U.S.C. 921(a)(3) and 27 CFR 478.11. Any person who manufacturers such frames or receivers for sale or transfers such frames or receivers must obtain a federal firearms license (FFL) from the Bureau of Alcohol Tabacco Firearms and Explosives (ATF) 18 U.S.C. 922(a)(1)(A). Under the GCA, licensed manufacturers must identify the frame or receiver of each firearm, with a serial number in accordance with regulations. 18 U.S.C. 921(a)(3)(C) and 923(i). With respect to "AR-15 Type Firearms," the lower receiver houses the FCU and is a "firearm," as defined by the GCA. The present disclosure is a bullpup-configured lower receiver assembly which includes a lower receiver that houses the FCU. As such, the present disclosure is a "firearm" as defined by the GCA, is required to be "serialized," and can only be manufactured for sale or transferred by an FFL.

The term "small arms" generally refers to a firearm designed to be held with one or both hands for firing. The term "long gun," or "long arm," generally refers to a category of "small arms" designed to be held with both hands and braced against the shoulder, and the term "handgun" or "pistol," generally refers to a category of small arms generally designed to be held and fired with a single hand without the need for bracing against the shoulder.

The term "rifle" generally refers to a category of small arms generally having a barrel with a "rifled" bore designed to induce spin and improve accuracy, use ammunition cartridges that fire a single projectile, and intended to be fired from the shoulder. Modern sporting rifles having a barrel length of 16 inches are commonly referred to as "carbines" In the United States, rifles having a barrel. of less than 16 inches (and an attached buttstock stock or other device for shouldering the firearm) are generally treated as "short-barreled rifles" (SBRs), the possession of which is restricted under the National Firearm Act (NFA) and federally regulated by the ATF.

Firearms are often categorized according to the method and mechanism employed to feed ammunition into and out of the firing chamber of the barrel. A semiautomatic firearm feeds ammunition and ejects spent ammunition cartridges without manual assistance from the firearm user. The firing cycle of a semiautomatic firearm ("semiautomatic cycle") begins when a round of ammunition is drawn into the chamber from the magazine or other ammunition feeding device. The first stage of the semiautomatic cycle begins when the trigger is pulled to cause the ammunition cartridge in the chamber to be ignited and to propel a projectile into the barrel of the firearm. In a semiautomatic firearm, the gas or force from this discharge causes the bolt assembly to be propelled rearward, which ejects the spent ammunition cartridge and resets and readies the hammer and trigger to be fired again. The second stage of the semiautomatic cycle commences when the rearward travel of the bolt assembly is reversed by recoil spring device that propels the bolt assembly forward to load an unfired cartridge into the chamber and complete the semiautomatic cycle.

"AR-15 Type Firearms" are modular firearms. The design of a modular firearm generally includes a two-part receiver assembly system, comprised of a lower receiver assembly and an upper receiver assembly that are commonly joined together by means of captured coupling pins (collectively, Receiver Pins). Modular firearms generally utilize other removable core components (or "modules") that can be reconfigured/interchanged to give the weapon different capabilities and allow the firearm to be adapted to immediate tactical needs by exchanging or replacing various modular components. Modular small arms, including assembly and disassembly features of upper and lower receiver assemblies, generally fall within Cooperative Patent Classification (CPC) classification F41A 11/00. Modular weapons family concepts, like those applicable to AR-15 Type Firearms, generally falls within CPC classification F41A 11/0. Concepts relating to the receivers or frames of modular firearms may also fall within CPC classification F41A 3/66.

SUMMARY OF THE INVENTION

Many examples of modular firearms are known in the art. Such examples include can modular firearms having a "conventional configuration" and also include those having a "bullpup" configuration. Modular firearm, including AR-15 Type Firearms, generally have an elongated "buttstock" to which the receiver, barrel and firing mechanism are attached. A buttstock is generally held against one's shoulder when firing the long arm and provides a means for the shooter to firmly support the device and easily aim it. In conventionally configured rifles that employ the use of magazines to load ammunition into the firing chamber, the grip, if any, and trigger for firing the weapon are located behind the magazine well of the rifle.

Unlike a conventionally configured modular firearm, the grip and operating trigger of a bullpup-configured firearm is located forward of the magazine well. Such forward positioned trigger is connected, thorough a trigger linkage system and assembly, to a fire control unit (FCU), which includes a trigger, hammer, and related springs and pins, located rearward behind the magazine well through a trigger linkage bar and assembly. A bullpup configuration generally allows for the buttstock and overall length (OAL) of the firearm to be to be shortened considerably without any loss in bullet velocity or effective range. The reduced OAL and forward located pistol grip of the bullpup configuration generally enables improved balance and maneuverability.

Bullpup configured rifles are often preferred by military, law enforcement, and civilians over a conventionally configured longarm as defense weapon due to the increased utility of the weapon in close quarters combat (CBQ). Military forces of Australia, Israel, China, Russia, and the United Kingdom, France, Singapore, Peru, Germany, Austria, Turkey, South Korea, and other countries have adopted bullpup configured rifles for use in military combat or as standard-issue rifles. For many of the same reasons, civilian firearm users often prefer the bullpup configuration over the conventional configuration of the same firearm.

Well known examples of bullpup-configured carbines and rifles available to civilians in the United States include the Steyr Aug, the Tavor X95, and the Springfield Hellion. Although typically more expensive than a conventionally configured rifle of equivalent quality, bullpup rifles have become increasingly popular in the U.S. retail firearm market. There are no known examples of a bullpup-configured firearm known in the art and/or manufactured and available for sale in the United States that can be operated in both a conventional configuration and a bullpup configuration.

Firearm users and enthusiasts have long debated the relative advantages and disadvantages of a conventionally configured rifle versus a bullpup-configured rifle. For those firearm users who already own a conventionally configured modern sporting rifle, the prospect of purchasing a second dedicated bullpup-configured firearm may be prohibitively expensive given the relatively high price of most dedicated bullpup firearms. Without the availability of the present disclosure, firearm users desiring to operate a modular firearm in a conventional configuration bullpup configuration firearm cannot do so in close temporal proximity without purchasing a dedicated firearm in each configuration.

Bullpup conversion kits, also referred to as "bullpup chassis" (collectively, Bullpup Conversion Kits) are well known in the art. These devices enable a firearm user who already possesses a conventionally configured firearm to "permanently" convert such firearm from a conventional configuration into a bullpup configuration. To effect such conversion, Bullpup Conversion Kits require the firearm user to install the required conversion parts on their firearm receiver. Installation of Bullpup Conversion Kits necessarily requires involves a plurality of parts and fasteners and the use of various tools. Moreover, installation generally requires the firearm user to possess significant firearms knowledge and gunsmith skills. This conversion process generally takes several minutes or even hours to complete. The "kit" design of Bullpup Conversion Kits necessarily limits the scope of application to a specific type of firearm and specific type, shape, and design of upper and lower receiver assemblies. Due to the wide variation and lack of uniformity in the upper and lower receiver assemblies found in host firearms, installation of Bullpup Conversion Kit often gives rise to certain fire control unit FCU malfunctions and may require the user to modify the host firearm and/or the conversion parts to accomplish a proper fitment.

Bullpup conversion kits do not include a lower receiver and are treated as mere "parts" rather than "frames or receivers" (which are "firearms" under applicable federal firearm law). Because Bullpup Conversion Kits do not include a lower receiver and must be assembled and attached to an existing firearm by the firearm user, such method of converting a conventionally configured firearm to a bullpup configuration cannot accomplished in a rapid manner. In stark contrast, a lower receiver manufactured in or modified to a bullpup configuration and assembled as unified single unit lower receiver assembly ("Bullpup Lower Receiver Assembly"), such as the present disclosure, enables a rapid and bidirectional conversion process ("Hot Swap") which allows the firearm user to alternate between a conventional configuration and bullpup configuration within a matter of seconds.

There are a number of Bullpup Conversion Kits currently sold in the U.S. Some additional examples can be found in the following design and utility patent applications and grants: U.S. Pat. Nos. 10,337,813B2 and D897,477-S (Jonsson); U.S. Pat. No. 4,463,654 (Barnes et al); U.S. Pat. No. 4,601,123 (Swaringin et al.); U.S. Pat. No. 4,677,781 (Lec); U.S. Pat. No. 4,869,008 (Rasmusen); U.S. Pat. No. 7,337,574 (Crandall et al); U.S. Pat. No. 7,356,958 (Wier); U.S. Design Pat. No. D693420-S (Abbott) et al.; U.S. Pat. No. 9,677,846 (Vankeuren III); U.S. Pat. No. 10,345,074 (Zamlinsky); U.S. Pat. App. No. 2011/0283582 (Hunter, et al).; U.S. Pat. App. No. 2017/0131051 (Albury); U.S. Pat. App. No. 2017/0115080 (Boettner); U.S. Pat. App. No. 2014/0075803 (Muller), and U.S. Pat. App. No. 2013/0185975 (Johnston).

A bullpup configured lower receiver assembly designed to fit AR-15 Type Firearms is the preferred embodiment of the present disclosure. Any such reference to "AR-15 Type Firearms" herein is meant to refer to all modular firearms similar in design to the AR-15 or M4 models manufactured by Colt Manufacturing or Armalite Manufacturing, or the original design of the AR-15 disclosed by Eugene Stoner, in U.S. Pat. No. 2,951,424, for use by U.S. armed forces. AR-15 Type Firearms are presently manufactured by many different manufacturers and millions of these firearms have been sold in the United States and around the world. Examples of such AR-15 Type Firearms in circulation today include those configured as rifles, carbines, SBRs, and pistols and can be found in a variety of rimfire and center fire ammunition cartridge calibers, including, but not limited to the following: .22 Long Rifle (commonly referred to as an "AR-22"); .223 Remington, 5.56×45 mm NATO, and .300AAC Blackout (commonly referred to as an "AR-15"), 9×19 mm Parabellum (commonly referred to as an "AR-9"); 308 Winchester and 7.62×51 mm NATO (commonly referred to as an "AR-10"). AR-15 Type Firearms using 12-gauge shotgun shells are common and are generally referred to as an "AR-12"). The most common configuration of AR-15 Type Firearm in circulation today is a carbine or modern sporting rifle having a barrel length of 16-18 inches, however the term "AR-15 Type Firearms" as used herein, also includes similar modular firearms configured with a shorter pistol-length barrel.

AR-15 Type Firearms designed for civilian use are generally configured to fire in semiautomatic mode. AR-15 Type Firearms generally utilize a magazine fed ammunition system; however, some variants of AR-15 Type Firearms are adapted to use a belt-fed ammunition system. As used herein, the term "AR-15 Type Firearms," refers to any and all modular firearm that falls within the family of AR-15 Type Firearms, regardless of the make, model, ammunition caliber, ammunition feeding device, semiautomatic, mode of fire (i.e., semiautomatic, automatic, or select fire), or aesthetic design features or modular components used in the upper or lower receiver assemblies therein.

The modular design of AR-15 Type Firearms allows for interchangeability of component parts, which is a defining characteristic of AR-15 Type Firearms and is perhaps the most significant factor attributed to the wide popularity of AR-15 Type Firearms among firearms users. Military specifications (Mil-spec) are standards put in place by the General Accountability Office (GAO) for defining requirements and standardized measurements of equipment used by the military. These standards have been established to guarantee interoperability, commonality and reliability for each part purchased for military use. Manufacture of parts for AR-15 Type Firearms to Mil-spec standards generally ensures that such part is interchangeable with other parts of an AR-15 Type Firearm manufactured to such Mil-spec standards. All Mil-spec receivers are required to be machined from 7075 aluminum forgings and T6 heat treated. The compatibility of a Mil-spec upper receiver and Mil-spec lower receiver, with respect to coupling, fit, and function is generally ensured. However, even with Mil-spec parts, the exterior design, contours, sizes, and shapes of lower receivers and upper receivers, and the component parts of such assemblies, can vary widely depending on manufacturer. This lack of uniformity presents significant challenges in finding a method of converting AR-15 Type firearms to a bullpup configuration that is universally applicable to all AR-15 Type Firearms regardless of such variances. Unlike all other bullpup conversion methods known in the art, the present disclosure is designed in a manner that enables such universal application.

Regardless of manufacturer, all AR-15 Type Firearms share a common modular design feature which utilizes an upper receiver assembly and a lower receiver assembly that are coupled together using a captured takedown pin and captured pivot pin in a manner (collectively, "Takedown Pins") that allows for rapid coupling and decoupling of the upper and lower receivers. When assembled, the upper receiver and lower receiver of the respective assemblies are secured to one another through rear and forward extensions on the upper receiver fitting between corresponding sidewalls forming notches or grooves on the lower receiver. The forward sidewalls and extension are fitted with a captured "pivot pin" to prevent the forward halves of the receivers from separating. Similarly, the rear sidewalls and extension employ a captured "takedown pin" to secure the two receivers together. To disconnect the upper receiver assembly from the lower receiver assembly, the takedown pin is sufficiently pushed out of the upper receiver rear extension and the pivot pin is similarly pushed out of the upper receiver forward extension to disconnect these extensions from the surrounding sidewalls and thereby completing allow separation of the lower receiver assembly from the upper receiver assembly.

The lower receiver assembly of an AR-15 Type Firearm includes the trigger, hammer, disconnector, and other components of the fire control unit (FCU), housed in the lower receiver, which is used to initiate firing of the weapon. The lower receiver is generally attached to a buttstock attached to the rear of the lower receiver by means of a lower receiver extension or "buffer tube" that houses a recoil buffer and buffer spring, A magazine box, used to houses the firearm's ammunition, inserts into the magazine well of the lower receiver and is held in place by catch and removed through use of a release. The lower receiver of AR-15 Type Firearms is the only component part on the firearm that is required to be serialized and which requires an FFL to transfer to civilians. The lower receiver assembly of a bullpup configured AR-15 Type is hereinafter referred to as the "AR-15 Bullpup Lower Receiver Assembly," and the lower receiver assembly of a conventionally configured AR-15 Type Firearm is often referred to herein as a "Conventional AR-15 Lower Receiver Assembly."

In general, the upper receiver assembly of an AR-15-Type Firearm includes an upper receiver which houses a reciprocating bolt and firing pin and other components of a bolt-carrier group (BCG), which chambers ammunition into the barrel attached to the front of the upper receiver. Other than in the case of the less common side charging upper receiver, the "charging handle" is most often located at the rear of the upper receiver and is used to "charge" or load the first round of ammunition from the magazine and lock it into the chamber of the barrel by means of the reciprocating bolt.

The upper receiver assembly of an AR-15 Type Firearm utilizes a gas-operated system in which a vent hole in the barrel is used to direct exhaust gases into a gas block and rearward to a BCG located in the upper receiver. The bolt housed within the BCG acts as a piston. In a direct impingement (DI) gas system, the exhaust gases travel through a steel gas tube to a key located at the front of the BCG. Alternatively, a short-stroke piston gas system utilizes a specialized gas block, piston, and BCG, whereby the exhaust gas enters the gas block and drives a piston rearward to propel the BCG rearward.

Upon activation of the AR-15 Firearm by means of pulling rearward the trigger located in FCU located in the lower receiver, the exhaust gases propels the BCG rearward and ejects the spent ammunition carriage to start the semi-automatic "cycling" of the firearm.

After the BCG is propelled rearward by exhaust gas, the operation of the second stage of the semiautomatic cycle depends upon the design of the BCG (and often the upper receiver) found used in the upper receiver assembly of the AR-15 Type Firearm. Most AR-15 Firearms in circulation in the United States today employ an upper receiver assembly that utilizes a DI gas system having a BCG designed for use in DI gas system and lower receiver buffered recoil system (DI Buffered BCG) rather than a proprietary piston-driven gas BCG (Piston-Driven BCG) or bufferless BCG (Bufferless BCG). Whether a DI Buffered BCG. Piston-Driven BCG or Bufferless BCG is employed, the two-stage semi-automatic cycle described above continues upon trigger activation until the ammunition in the magazine has been exhausted.

When a DI Buffered BCG is employed in the in the upper receiver assembly, the second-stage recoil operation is accomplished by use of a buffer tube (or lower receiver extension) located at the rear of the lower receiver assembly, and recoil buffer and buffer spring contained therein. Carbine-length AR-15 Type Firearms generally utilize a standard carbine-length buffer and buffer spring contained therein. The buffer tube must generally be at least 7.25" in length to allow the DI Buffered BCG to travel sufficiently rearward to reset the trigger and reload another round of ammunition. After the DI Buffered BCG is propelled rearward in the first stage of the semiautomatic cycle, it contacts the recoil buffer and compresses the recoil spring inside the buffer tube. Upon reaching full compression, the recoil spring then decompresses to redirect and propel the DI Buffered BCG back forward into the upper receiver and load a round of ammunition from the attached magazine and lock it into the chamber by means of the reciprocating bolt. thereby competing the semiautomatic "cycle" of the firearm.

When a Bufferless BCG is employed in the upper receiver assembly of an AR-15 Type Firearm (Bufferless Upper Receiver Assembly) there is no need for a buffer tube, buffer, or buffer spring (or any other recoil system) located in lower receiver assembly because the Bufferless BCG does not travel rearward beyond the back of the upper receiver and the Bufferless Upper Receiver Assembly incorporate a guide rod and recoil spring system into the Bufferless BCG which operates to propel the Bufferless BCG forward inside the Bufferless Upper Receiver Assembly to complete the second-stage of semi-automatic cycling.

Bufferless Upper Receiver Assemblies using proprietary Bufferless BCGs tend to be significantly more expensive than DI Buffered BCGs. There are a few far less common examples of proprietary Bufferless BCGs available in the market today which can be used with a DI gas system and DI Buffered BCG; however these examples tend to are quite expensive, are in short supply and tend to cycle an AR-15 Type Firearm much less reliably than DI Buffered BCGs. Based on the foregoing, any solution for converting a Conventional AR-15 Type Firearm into an AR-15 Bullpup Firearm requiring or dependent upon the user of a Bufferless Upper Receiver Assembly, Bufferless BCG, Piston-Driven BCG, or other proprietary or specialized BCG and/or gas system is likely to significantly increase production cost and such devices commercially unviable. The AR-15 Lower Receiver Assembly which is a preferred embodiment of the present disclosure can be used with any upper receiver assembly designed for an AR-15 Type Firearm regardless of the gas system, BCG, handguard, or other features therein. without the need for the firearm user to purchase any proprietary parts for use in the upper receiver assembly of the host AR-15 Type Firearm.

The AR-15 Bullpup Lower Receiver Assembly (PE1) that is a preferred embodiment of the present disclosure is compatible with all BCGs commonly found in AR-15 Type Firearms, including DI Buffered BCGs, Piston-Driven BCGs and Bufferless BCGs. The preferred embodiment (PE1) of the AR-15 Bullpup Lower Receiver Assembly that is the present disclosure includes a shortened bullpup-configured buttstock (Bullpup Buttstock), buffer tube, and recoil system (collectively, the Short Buffer System). The shortened buffer tube housed in the Bullpup Stock is less than 5.25" inches in length (most typically approximately 3.5" inches) which is significantly shorter than 7.25" buffer tube typically used in AR-15 Type Firearms. The Short Buffer System will accommodate the use of a plurality of recoil devices, including the two exemplary illustrations provided in the accompanying drawings. Certain of these recoil devices are capable of being "tuned" to increase or decrease the recoil properties.

There are millions of AR-15 Type Firearms in circulation in the U.S. today. There has long been significant public demand for an AR-15 Bullpup Firearm that is well priced, compatible with widely available and affordable AR-15 Parts and does not require the purchase of or use with expensive proprietary AR-15 components, has a well-functioning trigger with good "feel" and operates in a safe manner, adopts true bullpup length and other features, universally fits a variety of different AR-patterned firearms. To date, no design exists that meets these consumer preferences and there are no AR-15 Bullpup Firearms currently on the market in the U.S. Given the popularity and affordability of AR-15 Type Firearms and the appeal of bullpup configured rifles, much effort has been made to address perceived demand and develop an AR-15 Firearm that can be used in a bullpup configuration (AR-15 Bullpup Firearms). Each such effort known in the art all has taken one of the following two approaches to achieve an AR-15 Bullpup Firearm: (1) a dedicated bullpup-only configured rifle which utilizes ammunition of a caliber commonly found in AR-15 Type Firearms (AR-15 Caliber Bullpup Rifles); or (2) a Bullpup Conversion Kit designed for use in converting a Conventional AR-15 Type Firearm into an AR-15 Bullpup Firearm (AR-15 Bullpup Conversion Kits). As discussed herein, each of these two approaches has significant deficiencies.

AR-15 Caliber Bullpup Rifles are well known in the art. Some popular examples known in the industry include the following: Steyr Aug, Tavor X95," and Springfield Hellion. The average market price of AR-15 Caliber Bullpup Rifles is generally substantially more that the price of a comparably equipped Conventional AR-15 Type Firearms. Categorically, all known examples of AR-15 Caliber Bullpup Rifles share at least three common disadvantages which gives rise to the need for and benefits of the present disclosure: (1) AR-15 Caliber Bullpup Rifles utilize a proprietary Bufferless Upper Receiver and proprietary Bufferless BCG, and/or other upper receiver assembly parts that are not interchangeable with AR-15 Parts, which generally makes these bullpup rifles significantly less affordable than comparably equipped Conventional AR-15 Type Firearms; (2) AR-15 Caliber Bullpup Rifles utilize proprietary lower receiver assembly parts that are not compatible with upper receiver assemblies found on most AR-15 Type Firearms; and (3) AR-15 Caliber Bullpup Rifles have a full-time bullpup configuration and cannot be used in a Conventional AR-15 Type Firearm configuration.

There also some other lesser-known examples of AR-15 Caliber Bullpup Rifles, both in published patent applications and non-patent literature. Some of these examples utilize some AR-15 Parts in the design; but all such examples employ the use of a proprietary BCG and/or upper and receiver and/or other upper receiver assembly parts that are fully dedicated to a bullpup-only configuration and are not compatible with AR-15 Type Firearms. See US Pat. App. No. US2023/0128014-A (Makowski and Dewayne Lee Thompson); and US Pat. App. Pub. No. US2015/0338181-A1 (McAlister).

Other than AR-15 Caliber Bullpup Firearms, the only known method achieve an AR-15 Bullpup Firearm is what are known as "AR-15 Bullpup Conversion Kits." Prior to disclosure of the present disclosure, these AR-15 Bullpup Conversion Kits are the only known method, apparatus, device of any kind known in the art, whether in patent disclosure or non-patent literature, which enable conversion of a firearm user's existing Conventional AR-15 Type Firearm into an AR-15 Bullpup Firearm. All AR-15 Bullpup Conversion Kits share the same significant conversion and usage limitations common to all Bullpup Conversion Kits. As noted above, the design of Bullpup Conversion Kits often requires the use of a proprietary or specific upper receiver, BCG, handguard, and/or modifications to the firearm's upper receiver assembly.

Because AR-15 Bullpup Conversion Kits do not include a lower receiver, they cannot possibly enable a rapid conversion process. All AR-15 Bullpup Conversion Kits known in the art employ a bullpup conversion process that requires the firearm user to assemble and install several component parts using several fasteners to attach the components to the lower receiver of the firearm user's host AR-15 Type Firearm. This conversion process requires the use of tools and generally takes several minutes or more to complete. Such conversion also results in a bullpup-only configuration that renders unavailable the firearm user's Conventional AR-15 Type Firearm. Once converted using an AR-15 Bullpup Conversion Kit, as similar lengthy process (in reverse) using tools to remove fasteners and bullpup conversion parts is required to convert the resulting AR-15 Bullpup Firearm back to its Conventional AR-15 Type Firearm configuration. Operation of AR-15 Bullpup Firearms converted using a AR-15 Bullpup Conversion Kit typically requires the firearm user to purchase other proprietary AR-15 components and such use is generally limited to a specific type and/or style of upper receiver assembly or components employed therein. One of the most troubling aspects of AR-15 Bullpup Conversion Kits is the wide variance in results and operational risks inherent in such design, which have often been encountered by firearm users when installing and such AR-15 Bullpup Conversion Kits on their host lower receiver and operating the AR-15 Type Firearm resulting therefrom. These and other operational deficiencies resulting from the inherent user-installation aspect of such approach, wide variation in fire control units (FCU) of firearm user' host lower receivers, and the "push style" trigger linkage systems (Push Style Trigger Linkage System) employed in these AR-15 Type Bullpup Conversion Kits. As a result, the function of the trigger and trigger linkage system in such AR-15 Type Bullpup Firearms converted using an AR-15 Bullpup Conversion Kit can vary widely, and even result in accidental discharge of the firearm. This inherent danger is noted in the installation and operating manuals of some Bullpup Conversion Kits and has been widely reported by firearm users.

There are relatively few known examples of such AR-15 Bullpup Conversion Kits in the art. Sec U.S. patent applications and grants U.S. Pat. No. 11,644,260 B1 (Dovier); US 2024/0077270 A1 (Popp, et al.) and US 2014/0075812A1 (Johnson) There are also several examples of such AR-15 Bullpup Conversion Kits disclosed in non-patent literature.

All of the above-referenced examples of AR-15 Bullpup Conversion Kits known in the art require the firearm user to attach a plurality of bullpup conversion parts to the lower receiver of the firearm user's AR-15 Type Firearm using tools and fasteners in a process that takes several minutes or more to complete. None of the above-referenced examples of AR-15 Bullpup Conversion Kits known in the art is a firearm lower receiver assembly or incorporates a specialized bullpup-configured lower receiver or is manufactured or assembled in a single unified unit to enable a truly rapid conversion of a Conventional AR-15 Type Firearm to an AR-15 Bullpup Firearm (and vice versa). Nor is any such AR-15 Conversion Kit known in the art widely or universally applicable to the majority of AR-15 Type Firearms in circulation in the U.S. today. Each of the Bullpup Conversion Kits known in the art are designed to fit only those host AR-15 Type Firearms having a specific lower receiver (typically a Mil-spec lower receiver with an open trigger guard) and only specific type of BCG, gas system and/or handguard employen in the upper receiver assembly component of the host AR-15 Type Firearm.

Many of the AR-15 Bullpup Conversion Kits known in the art, including the one illustrated in the Dovier and Popp et al. patent applications are designed to be used only with a Bufferless BCG or other specific proprietary BCG, a specific type, shape and style of handguard, or other specific upper receiver assembly components. receiver assembly and/or lower receiver assembly of the host AR-15 Type Firearm (e.g., proprietary short buffer tube/recoil system, Bufferless BCG or DFA skeletonized/shortened BCG, low-profile (LP) free-float handguard, forward-placed charging handle, etc.). This requirement to utilize specific proprietary parts can not only add additional expense required to make use of the AR-15 Bullpup Conversion Kit but also increase the amount of time needed to accomplish a bullpup conversion therefrom.

All of the AR-15 Bullpup Conversion Kits known in the art, including the above-referenced examples, employ a Push Style Trigger Linkage System whereby the trigger in the fire control unit (FCU) of the lower receiver is activated by a bushing located at the rear end of a trigger linkage system, which is placed directly in front of the trigger bow of such FCU trigger, pushing on such FCU trigger and thereby releasing the hammer to propel the firing pin and detonate the ammunition in firearm chamber. The design and physics of such Push Style Trigger Linkage Systems fails to efficiently utilize principles of leverage and generally requires use of a robust or rigid trigger bar to prevent flex and friction during operation. These Push Style Trigger Linkage Systems require firearm user installation and adjustment of the rear trigger bushing to address the wide variances in host AR-15 lower receivers and FCU triggers, which can give rise to trigger malfunction during operation.

The preferred embodiments of the present disclosure applicable to AR-15 Type Firearms (AR-15 Bullpup Lower Receiver Assembly) is lower receiver assembly having a "bullpup" configuration and unified single unit method of assembly thereof that enables a rapid and bidirectional single unit conversion ("Hot Swap") of AR-15 Type Firearms into a bullpup configuration and back to the original (conventional) configuration (Conventional AR-15 Type Firearm). The preferred embodiment of the present disclosure, AR-15 Bullpup Lower Receiver Assembly, is designed to address and resolve each of the limitations, including the deficiencies associated with the Push Style Trigger Linkage Systems used in AR-15 Bullpup Conversion Kits. The present disclosure AR-15 Bullpup Lower Receiver Assembly utilizes a novel "pull style" trigger linkage system (Pull Style Trigger Linkage System) that activates the FCU trigger that users leverage and "pulls" the FCU trigger from a position above the trigger bow, which results in optimal trigger efficiency, performance, feel and safety. This levered design also achieves a desirable trigger pull weight in a safe manner without any assisting spring. Because the FCU trigger in a Push Style Trigger Linkage System is pulled rather than pushed it is not subjected to trigger bar flex and trigger slop that must be addressed and managed with the Push Style Trigger Linkage Systems utilized in all AR-15 Bullpup Conversion Kits. The Pull Style Trigger Linkage System utilized in the AR-15 Bullpup Lower Receiver Assembly is specifically engineered for a bullpup configuration and is designed to be integrated into a specialized Bullpup Lower Receiver housing a specialized bullpup-configured FCU trigger. This Pull Style Trigger Linkage System also includes a levered front bullpup trigger and levered rear trigger connected by a trigger linkage rod that is far more efficient and travels on a relatively higher path than the Push Style Trigger Linkage Systems used in all AR-15 Bullpup Conversion Kits known in the art.

Based on the foregoing, there is a need for a commercially viable and affordable solution for a Bullpup Lower Receiver Assembly that enables a rapid and bidirectional conversion of a Conventional AR-15 Type Firearm to and from an AR-15 Bullpup Type Firearm in a manner that is does require user assembly or the purchase of proprietary upper receiver parts is universally applicable to the many different variants of upper receiver and lower receiver assemblies found in the AR-15 Type Firearms in circulation today. A preferred embodiment of the present disclosure applicable to AR-15 Type Firearms (AR-15 Bullpup Lower Receiver Assembly or "PE1") provides such a solution. There is a similar need for incorporation of the present disclosure, into the design and manufacture of new AR-15 Firearms and other modular firearms.

The present disclosure Bullpup Lower Receiver Assembly is a complete bullpup-configured lower receiver assembly designed in a unified single unit manner to enable a firearm user to perform a "Hot Swap" rapid conversion of a modular firearm from a conventional configuration to a bullpup configuration (and vice versa) so that both configurations are readily available to the firearm within a matter of seconds. No such invention has previously been disclosed in the art, either in patent application disclosures or in non-patent literature. One of the preferred embodiments of the present disclosure, the AR-15 Bullpup Lower Receiver Assembly, enables such a bidirectional "Hot Swap" rapid conversion of a Conventional AR-15 Type Firearm to an AR-15 Bullpup Firearm (and vice versa) by simply coupling or decoupling the takedown and receiver pins commonly located on both the lower receiver assembly of AR-15 Type Firearm and the AR-15 Bullpup Lower Receiver Assembly. The manner of such assembly of the AR-15 Bullpup Lower Receiver Assembly negates the need for any assembly by the firearm user and makes the AR-15 Bullpup Lower Receiver Assembly universally applicable to the several variations in upper receiver assemblies and lower receiver assemblies found in AR-15 Type Firearms in circulation today.

There is no known example of an AR-15 Caliber Bullpup Rifle that is readily convertible into an Conventional AR-15 Type Firearm and no known example of any AR-15 Bullpup Conversion Kit (or other Bullpup Conversion Kit) that includes a lower receiver in a lower receiver assembly or is otherwise assembled in a unified single unit lower receiver assembly to enable such rapid and bilateral conversion without the use of any tools, by means of coupling and decoupling the takedown and pivot pin which are commonly placed on the bullpup configured and conventionally configured lower receiver assemblies. There is also no known example of any AR-15 Bullpup Conversion Kit that is universally applicable to all or substantially all AR-15 type firearms regardless of the type or style of the lower receiver design or handguard design. All prior art relating to AR-15 Bullpup Firearms, whether accomplished by means of an AR-15 Caliber Bullpup Rifle and a Bullpup Conversion Kit, have significant deficiencies, limitations and disadvantages and limitations as compared to the present disclosure, which will become apparent to one of skill in the art and science, through comparison of described prior art with some aspects of the present disclosure, as set forth in the remainder of the present application and with reference to the drawings.

The present disclosure is a bullpup-configured lower receiver assembly (Bullpup Lower Receiver Assembly) assembled in a unified single unit to enable rapid and bidirectional conversion of a Conventional AR-15 Type Firearm and other modular firearms into a bullpup-configured firearm and back to a conventional configuration (Conventional AR-15 Type Firearm). The present disclosure has several different embodiments, each of which enables such "Hot Swap" conversion. Such embodiments vary depending upon the particular type of modular firearm and preferences of its user. The preferred embodiment of the present disclosure is applicable to AR-15 Type Firearms (AR-15 Bullpup Lower Receiver Assembly) is described herein. Each such AR-15 Bullpup Lower Receiver Assembly includes and incorporates a complete lower receiver that has been configured to enable bullpup configuration conversion (AR-15 Bullpup Configured Lower Receiver). The "Hot Swap" conversion of a Conventional AR-15 Type Firearm to an AR-15 Bullpup Firearm, and vice versa, (which is enabled by the unified single unit method of assembly of the AR-15 Bullpup Lower Receiver Assembly and can be performed by a firearm user in a matter of seconds without the use of any tools, fasteners, assembly by the firearm user, or requirement for the user to purchase or use an specific or proprietary AR-15 component parts) is accomplished by means of decoupling the captured pivot pin and takedown pion (collectively, the Receiver Pins) on the lower receiver assembly of the Conventional AR-15 Type Firearm, removing the upper receiver assembly from the Conventional AR-15 Type Firearm, placing it onto the AR-15 Bullpup Lower Receiver Assembly, and recoupling the upper receiver assembly with AR-15 Bullpup Lower Receiver Assembly using the identically sized and located Receiver Pins therein. The preferred embodiment AR-15 Lower Receiver Assembly is universally applicable to all or substantially all types of AR-15 Type Firearms in circulation, regardless of the type of lower receiver, upper receiver, BCG, handguard, or gas system employed therein. There is no other known invention known in the art that enables a bullpup conversion using a complete bullpup lower receiver assembly or otherwise enables any a rapid and universally applicable bullpup conversion without the use of tools or fasteners, assembly by the firearm user, or the use of a proprietary upper receiver assembly parts. Other objects and advantages of the present disclosure will become apparent to one knowledgeable in the art and science from the following description taken in connection with the accompanying drawings, wherein is set forth by way of illustration and example, embodiments of this invention.

BRIEF DESCRIPTION OF THE SEVERAL VIEW OF THE DRAWINGS

The drawings described herein are exemplary and refer only to selective and preferred embodiments of the present disclosure configured as an AR-15 Bullpup Lower Receiver Assembly. These drawings are not intended to describe all possible implementations or to limit the scope of the present disclosure.

Figure 10:
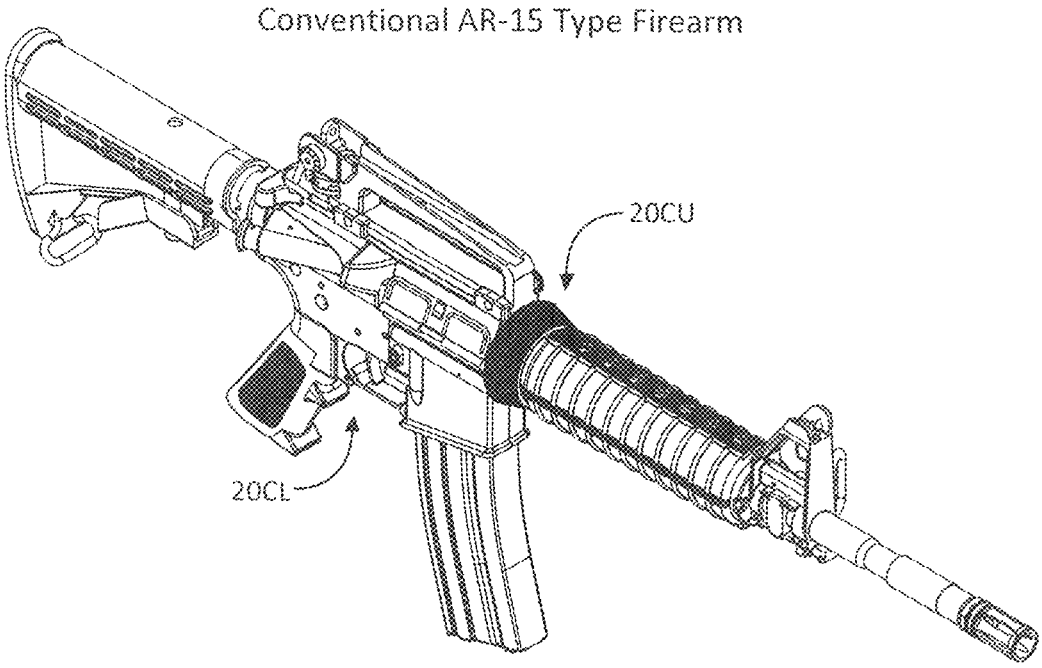
FIG. 10 (Prior Art)
FIG. 10 is prior art and is a front right ride elevational view of an exemplary Conventional AR-15 Type Firearm, in this example having a carbine length rifle barrel, A2-style gas-block and delta-ring style handguard.
Figure 11:
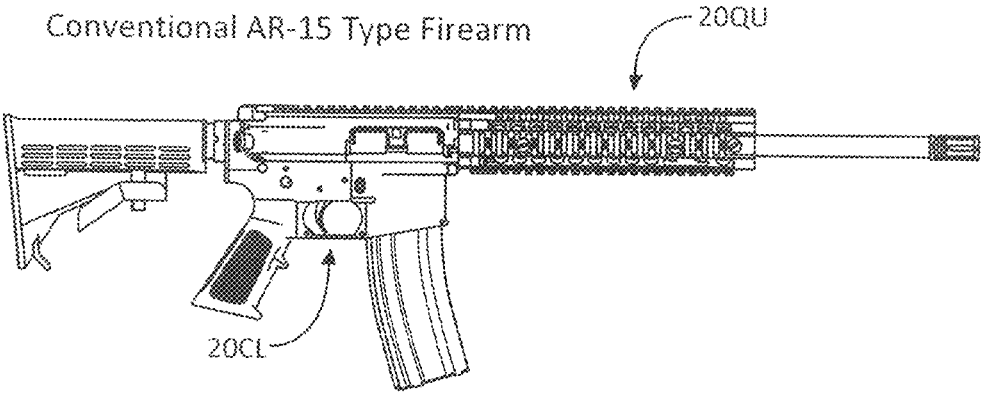
FIG. 11 (Prior Art)
FIG. 11 is prior art and is a right-side view of an exemplary Conventional AR-15 Type Firearm, in this example having a carbine length rifle barrel and free-float (FF) quadrail (QR) style handguard.
Figure 14:
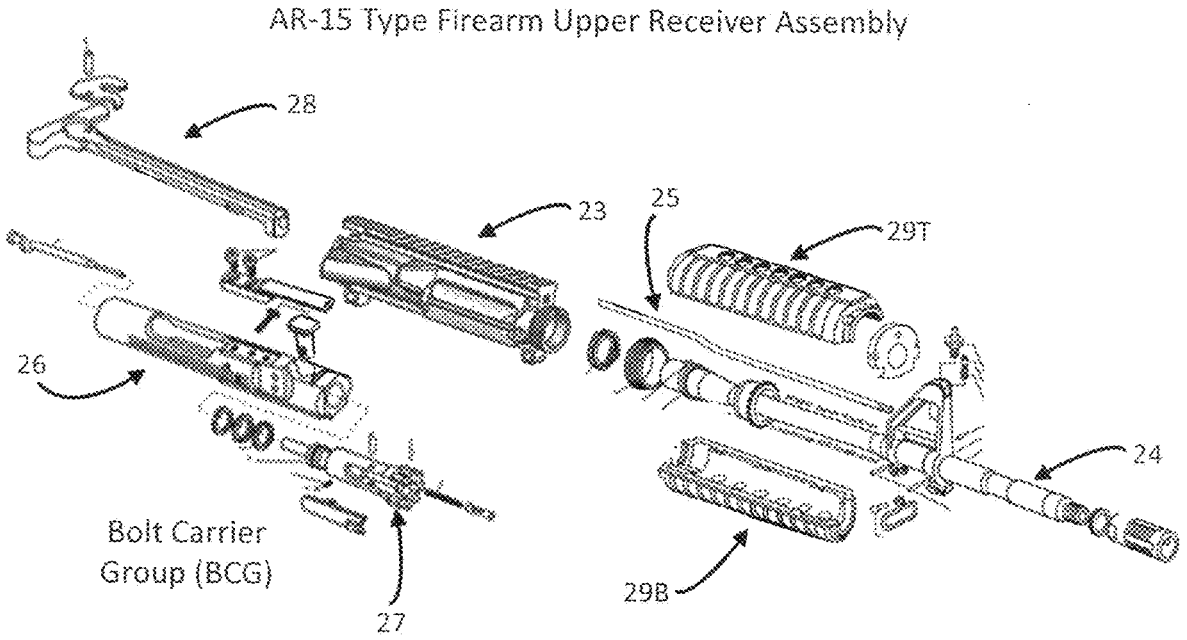
FIG. 14 (Prior Art)

FIG. 14 is prior art and is an elevated right-side view of the component parts of the upper receiver assembly of an exemplary Conventional an AR-15 Type Firearm. The Conventional AR-15 Type Firearm shown in FIG. 10 is used for purposes of such illustration; however, there are several other variants of such upper receiver assemblies and such examples may have significant differences with respect to the BCG, gas system and handguard component parts employed therein.

Figure 15:
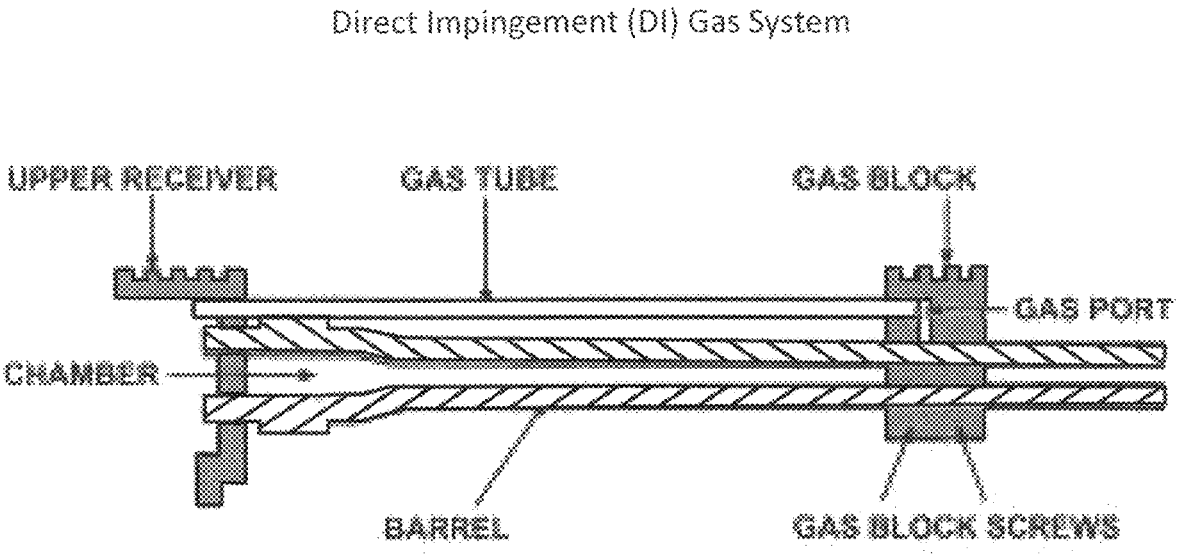
FIG. 15 (Prior Art)

FIG. 15 is a right-side view of exemplary component parts comprising a direct impingement (DI) gas system typically found in an upper receiver assembly of Conventional AR-15 Type Firearms.

Figure 16:
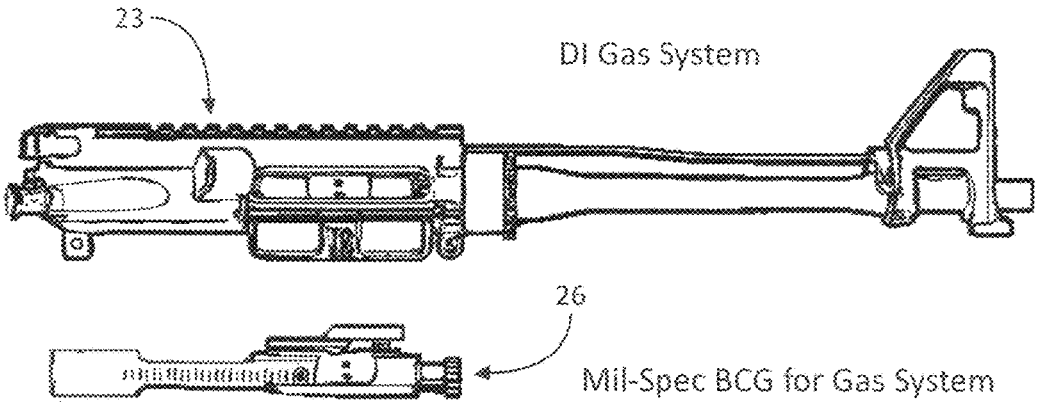
FIG. 16 (Prior Art)

FIG. 16 is a right-side view of exemplary component parts typically found in an upper receiver assembly of Conventional AR-15 Type Firearm utilizing a DI Buffered BCG and DI gas system.

Figure 17:
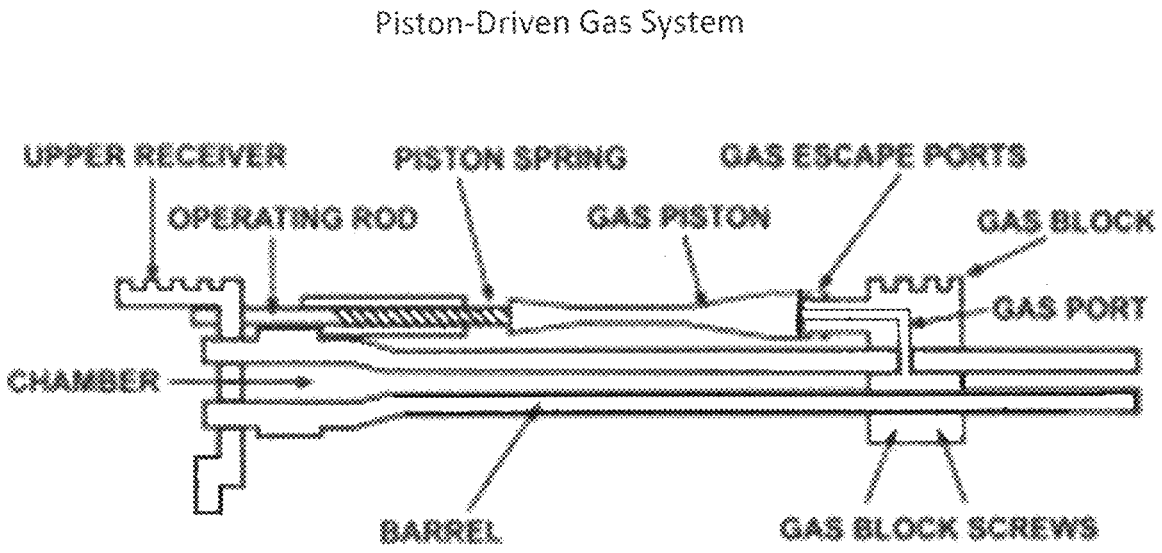
FIG. 17 (Prior Art)

FIG. 17 is a right view of exemplary view of component parts comprising a piston-driven gas system designed for use in a Conventional AR-15 Type Firearms.

Figure 18:
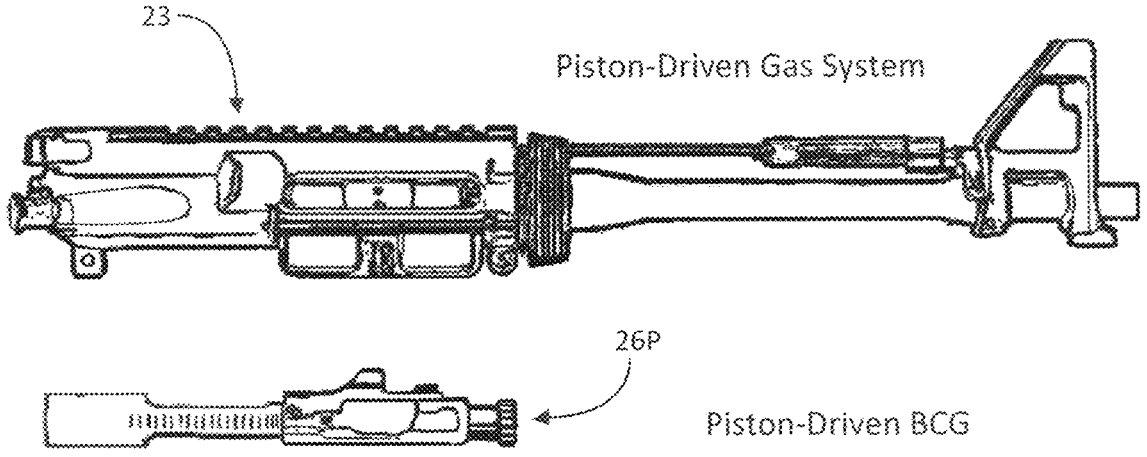
FIG. 18 (Prior Art)

FIG. 18 is right-side view of exemplary component parts typically found in an upper receiver assembly of Conventional AR-15 Type Firearm utilizing a piston-driven gas system, including an exemplary Piston-Driven BCG of the kind typically housed in the upper receiver of such piston-driven upper receiver assemblies.

Figure 19:
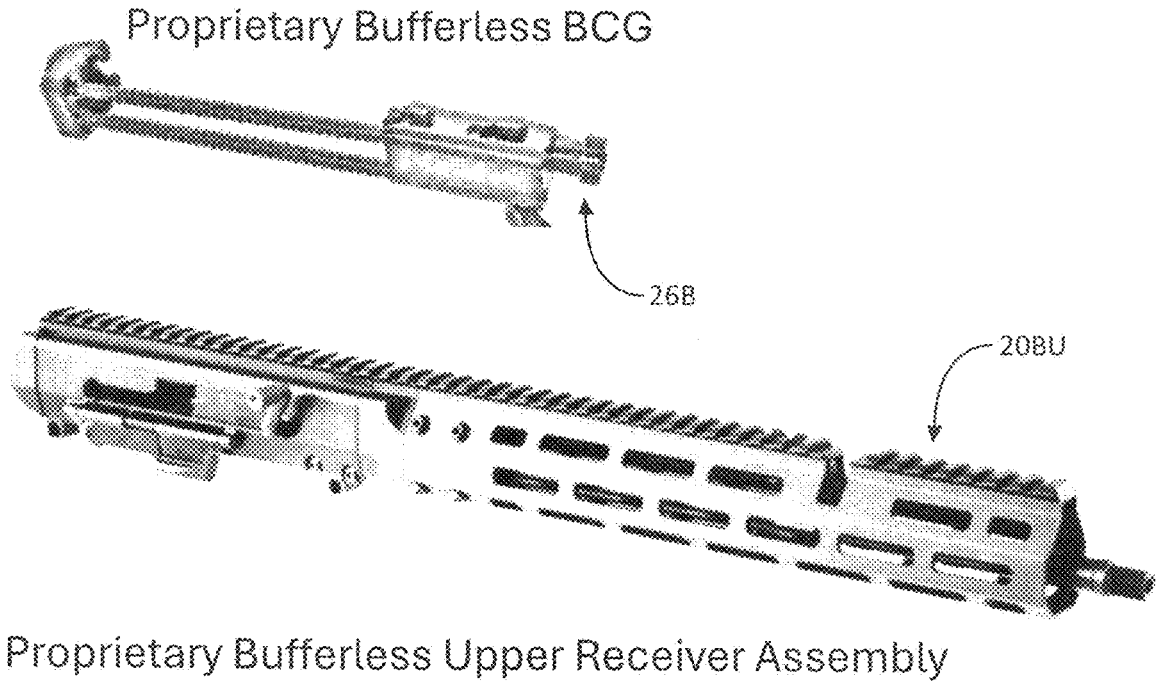
FIG. 19 (Prior Art)

FIG. 19 is an elevational right-side view of one of several known examples of bufferless upper receiver assemblies currently available for use in a Conventional AR-15 Type Firearm (Bufferless Upper Receiver) including the Bufferless BCG housed therein. All such Bufferless Upper Receivers and the Bufferless BCG are proprietary and the design of both can vary widely and the use thereof typically requires some accompanying bufferless components and/or modification of the lower receiver assembly of the Conventional AR-15 Type Firearm.

Figure 20:
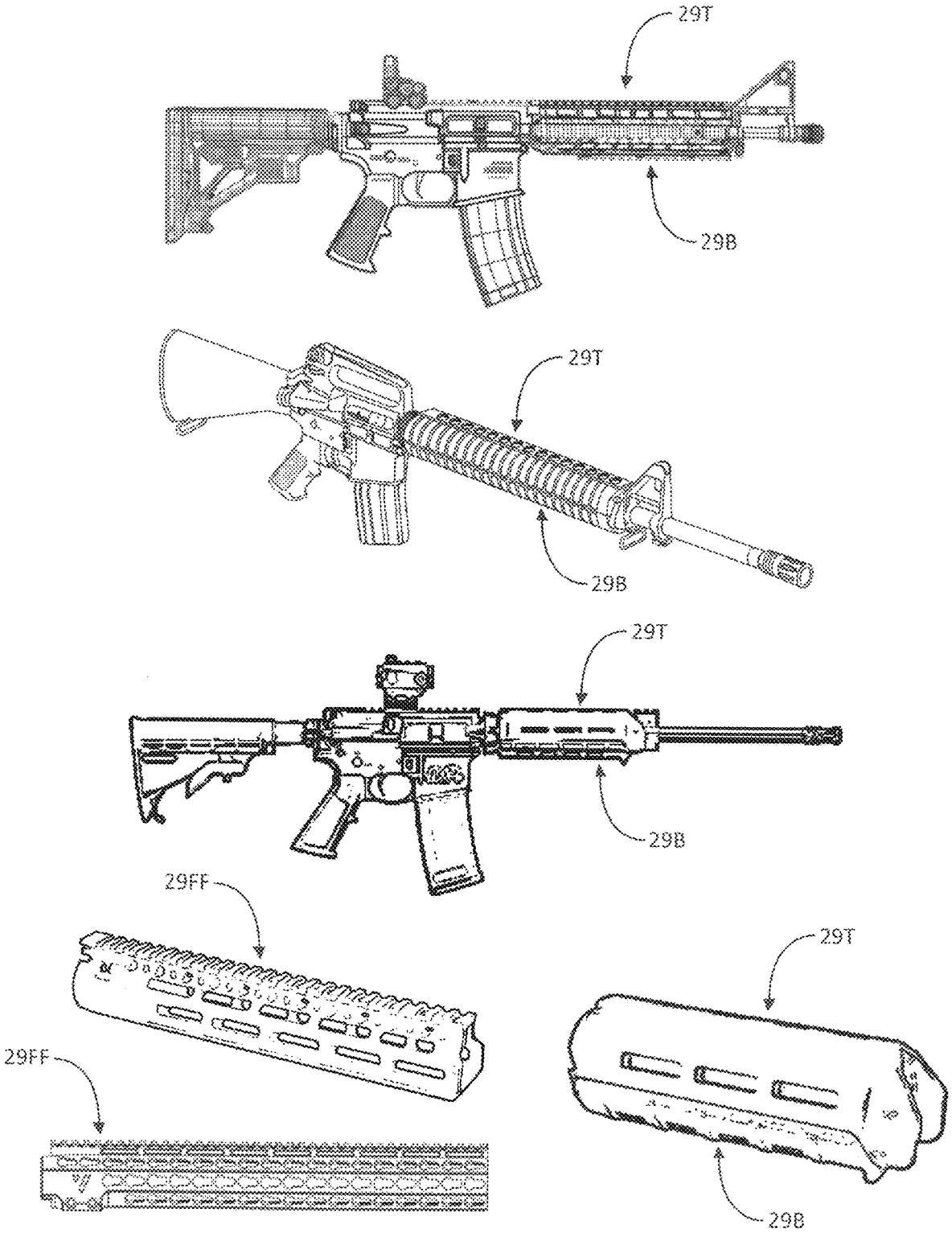
FIG. 20 (Prior Art)

FIG. 20 illustrates several exemplary handguard configurations typically found on the upper receiver assemblies of Conventional AR-15 Type Firearms. The size, shape, and design of such handguards can vary widely.

Figure 21:
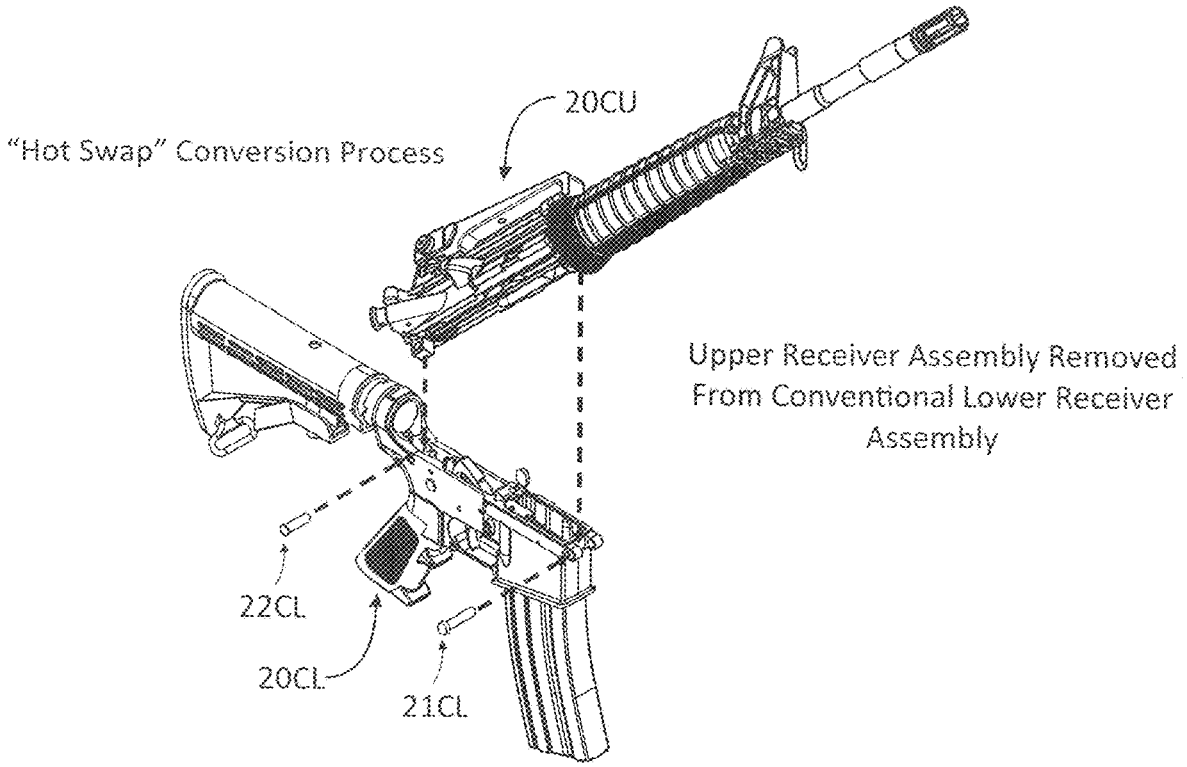

FIG. 21 illustrates the first step for the "Hot Swap" rapid conversion of a Conventional AR-15 Type Firearm into an AR-15 Bullpup Firearm (i.e., the decoupling and removal of the upper receiver assembly from the lower receiver assembly of the Conventional AR-15 Type Firearm). This is accomplished by retracting the two captured coupling pins (collectively Receiver Pins) located in the lower receiver assembly of the Conventional AR-15 Type Firearm and lifting the upper receiver assembly away from the lower receiver assembly of the Conventional AR-15 Type Firearm.

Figure 22:
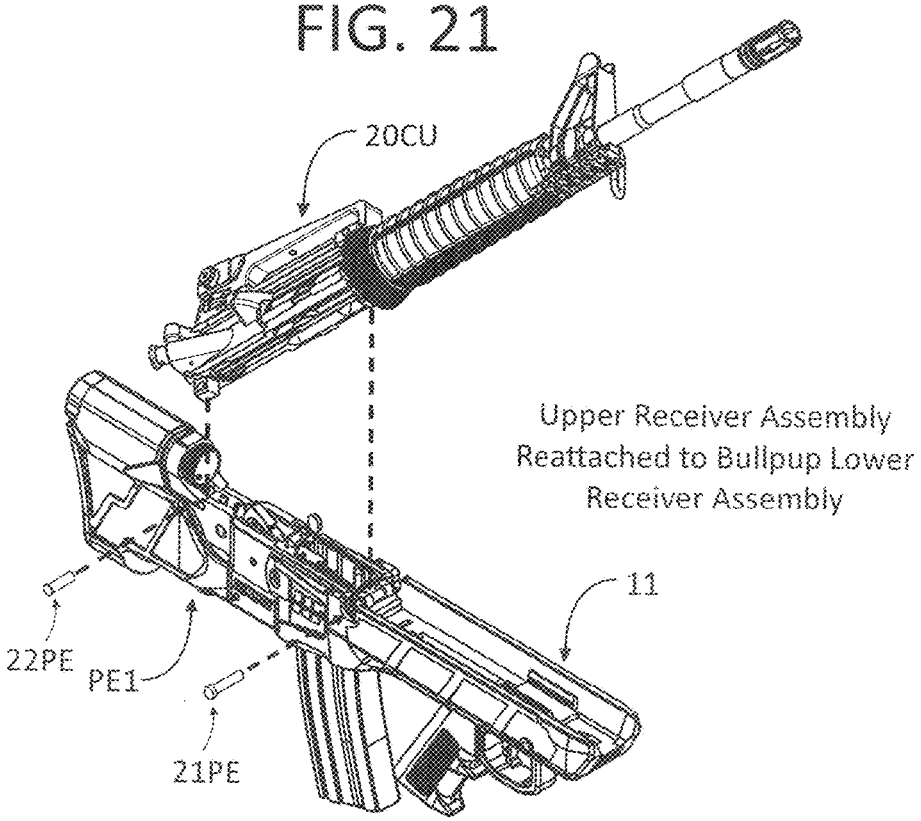

FIG. 22 is a front-left elevational view illustrating the second and final step for rapid "Hot Swap" rapid conversion of a Conventional AR-15 Type Firearm into an AR-15 Bullpup Firearm using the present disclosure (i.e., placement of the upper receiver assembly removed from the Conventional AR-15 Type Firearm (the example here shown with an A2 style gas block and delta-ring handguard) and placement onto the AR-15 Bullpup Lower Receiver Assembly (with preferred embodiment PE 1 shown here) and coupling of these upper and lower receiver assemblies by pushing in the two commonly located, captured Receiver Pins of the AR-15 Bullpup Lower Receiver Assembly.

Figure 12:
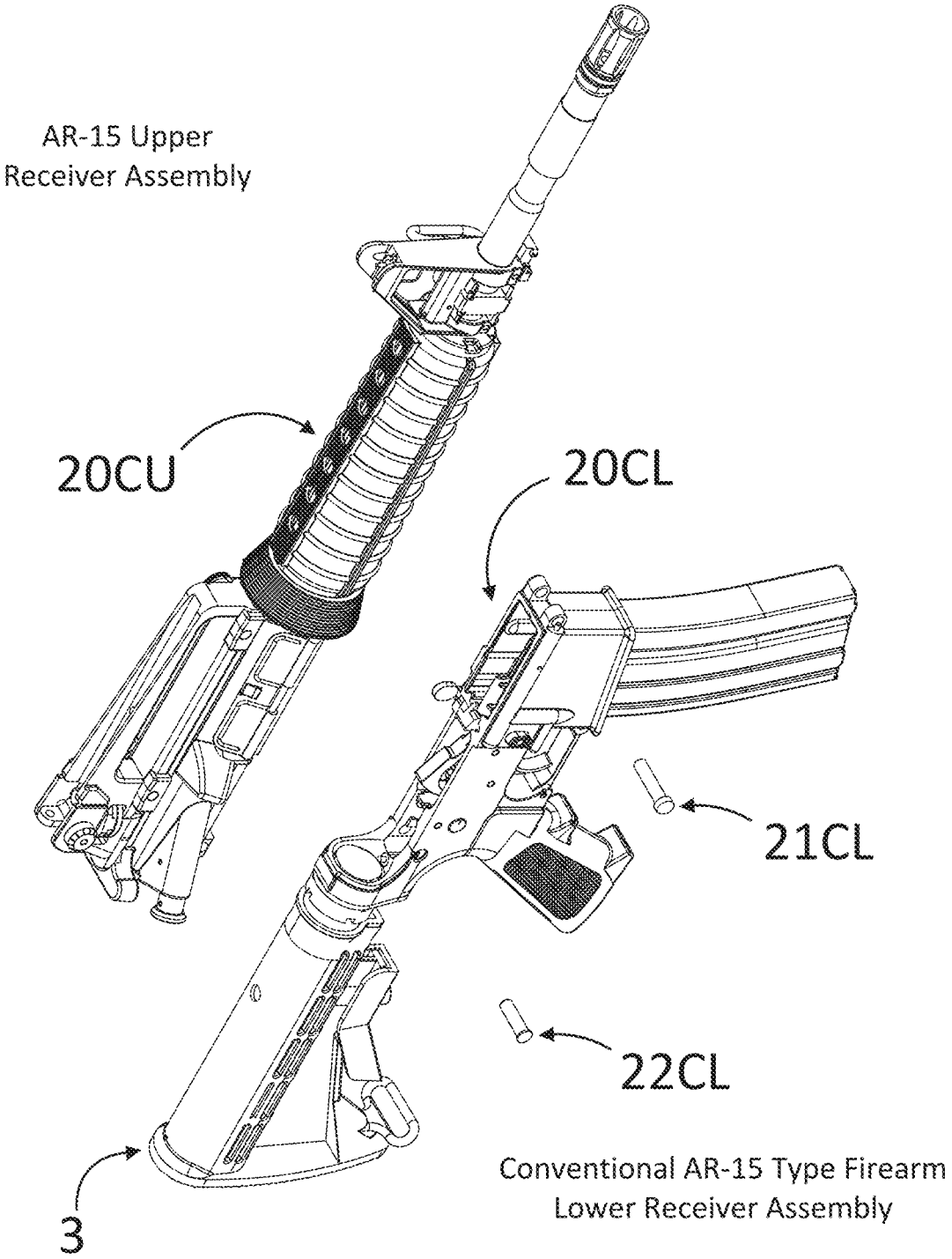
FIG. 12 (Prior Art)
FIG. 12 is prior art and a right-side elevational view of the exemplary Conventional AR-15 Type Firearm shown in FIG. 10, after having separated the upper receiver assembly from its lower receiver assembly.
Figure 23:
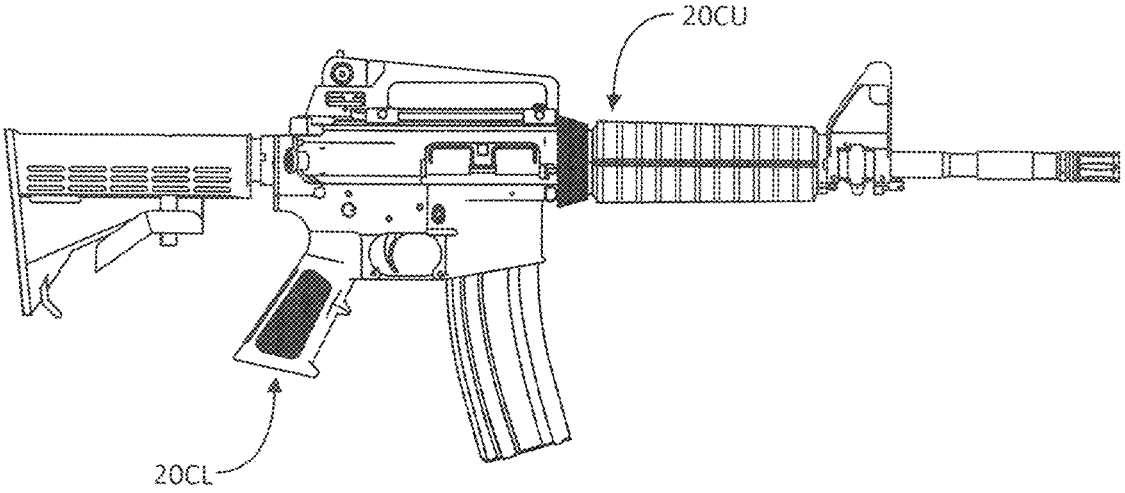
FIG. 23 (Prior Art)

FIG. 23 is a right ride view of the exemplary Conventional AR-15 Type Firearm illustrated in FIG. 10, FIG. 12, and FIG. 21.

Figure 1:
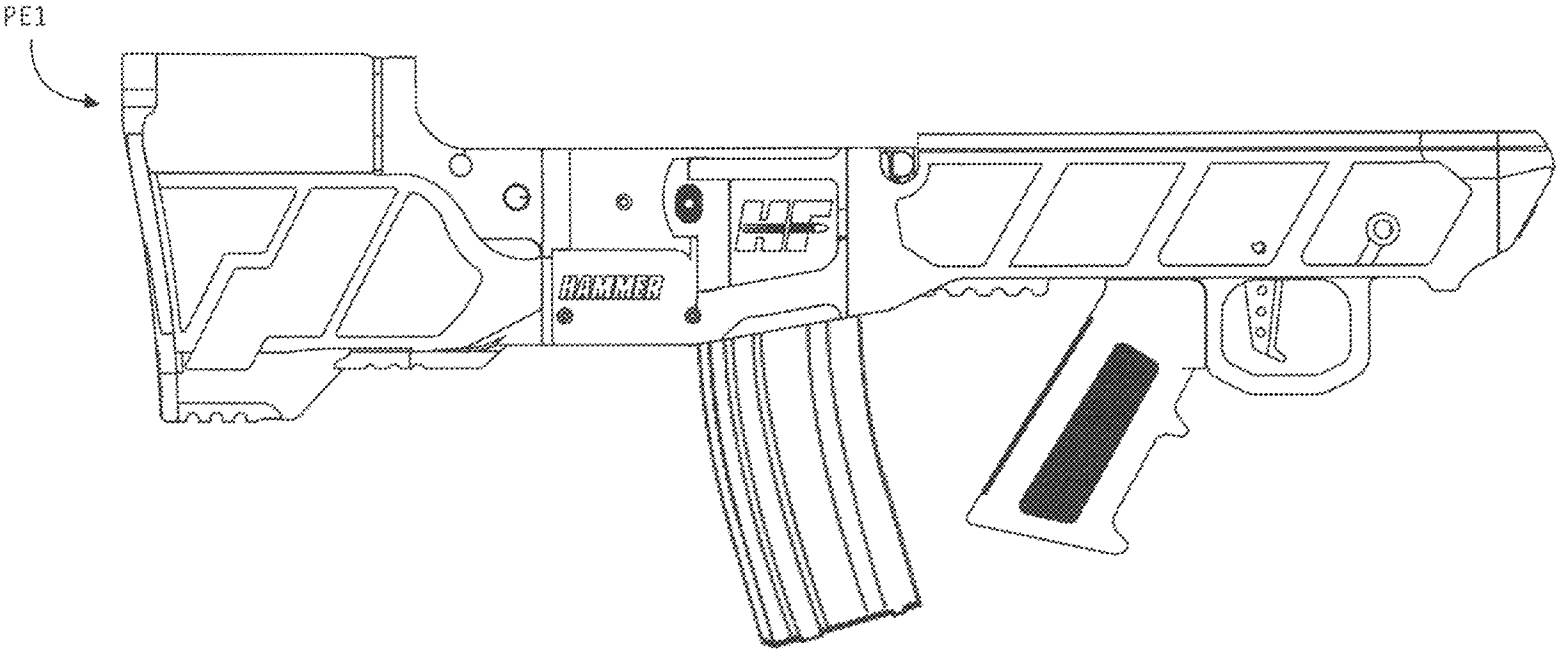
FIG. 1 is a right-side perspective of one of the preferred embodiments of the present disclosure (PE1) for conversion of an AR-15 Type Firearm to a bullpup configured firearm (Bullpup AR-15 Type Firearm).
Figure 2:
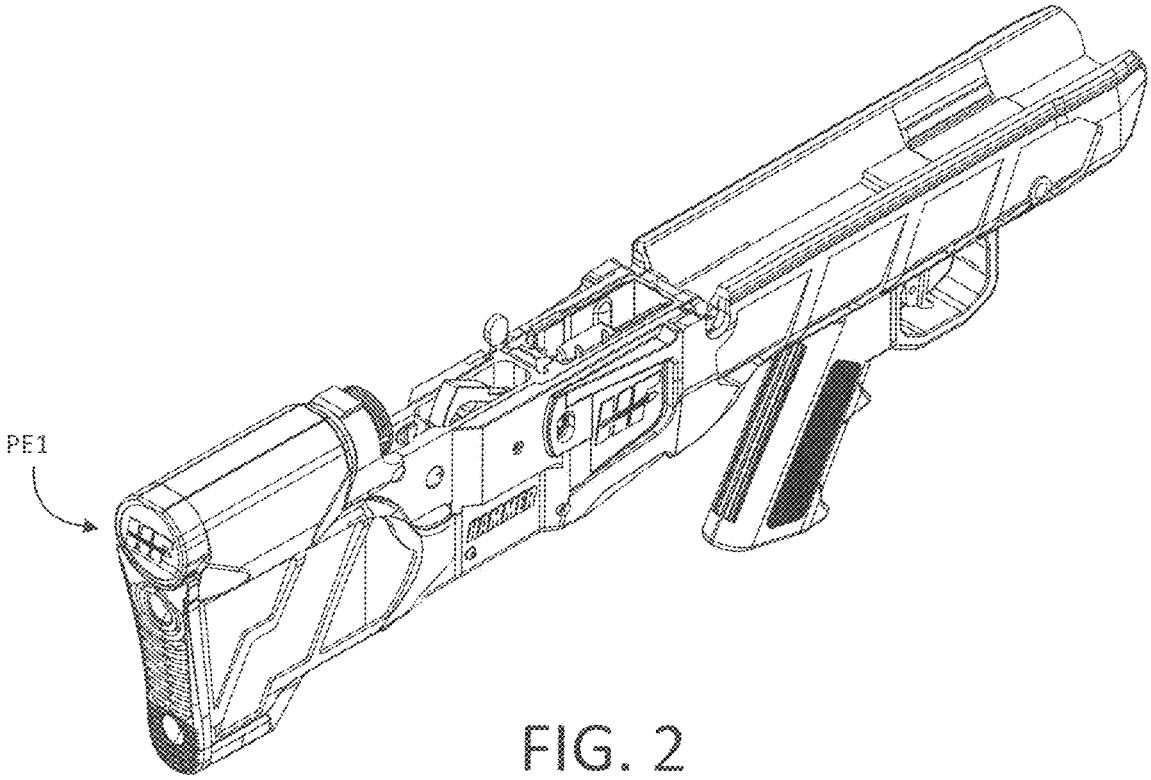
FIG. 2 is an elevational rear right-side view of the present disclosure embodiment illustrated in FIG. 1.
Figure 3:
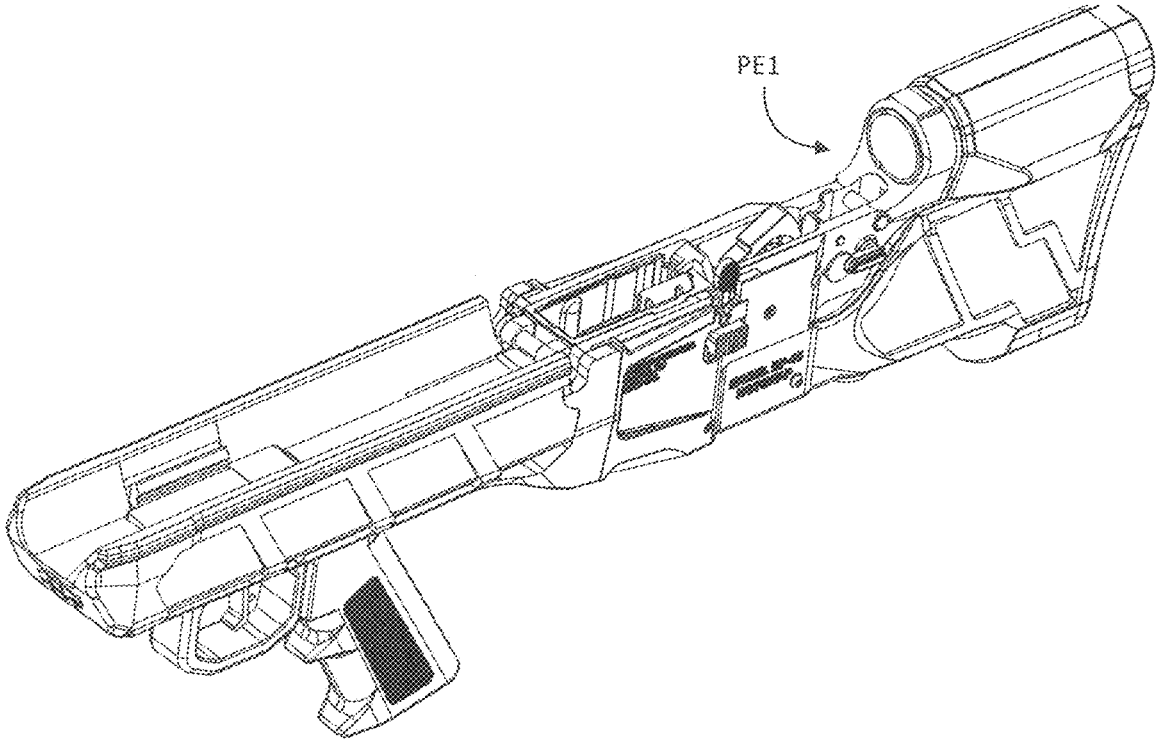
FIG. 3 is a left-side elevational view of the present disclosure embodiment illustrated in FIG. 1.
Figure 24:
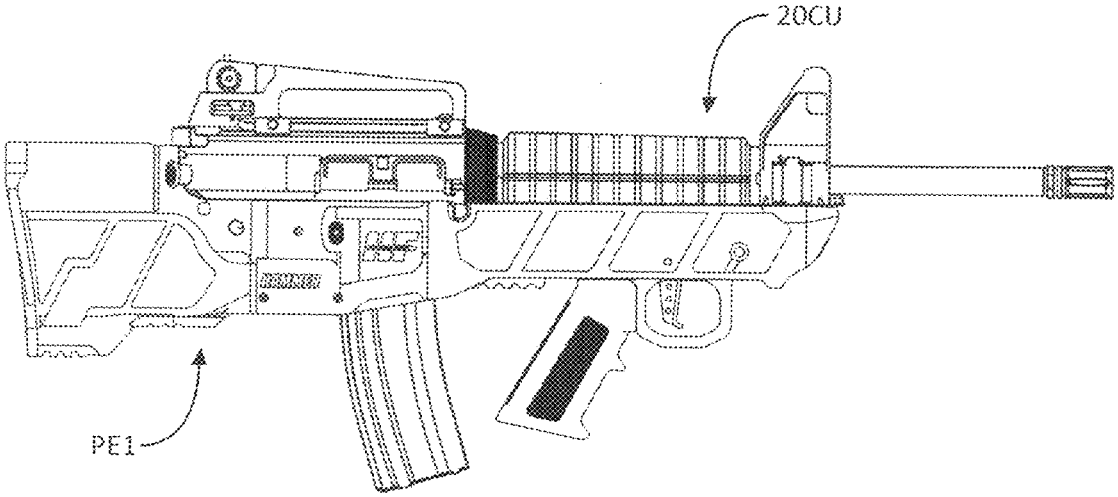

FIG. 24 is an embodiment of an AR-15 Bullpup Firearm (i.e. bullpup-configured AR-15 Type Firearm) having an exemplary upper receiver assembly from a Conventional AR-15 Type Firearm, illustrated here having the design shown in FIG. 10, FIG. 12 and FIG. 21, and joined and attached in an operable capacity to the preferred embodiment of the present disclosure PE1 illustrated in FIG. 1. FIG. 2, and FIG. 3. The AR-15 Bullpup Firearm shown in FIG. 24. can be rapidly converted back into the Conventional AR-16 Type Firearm shown in FIG. 23 by reversing the steps of the two-step conversion process illustrated in FIGS. 21 and 22. Depending handguard of the host upper receiver assembly and which of the associated fore-end attachment pieces (FAPs) employed in the Bullpup Fore-end of the present disclosure to attach the front end of the present disclosure to the handguard to the upper receiver assembly, such conversion back into a Conventional AR-15 Firearm configuration may require that the firearm user first extract (i.e., pull out) the captured pin located on the fore-end of the present disclosure (23PE shown on FIG. 4 and FIG. 5.

Figure 25:
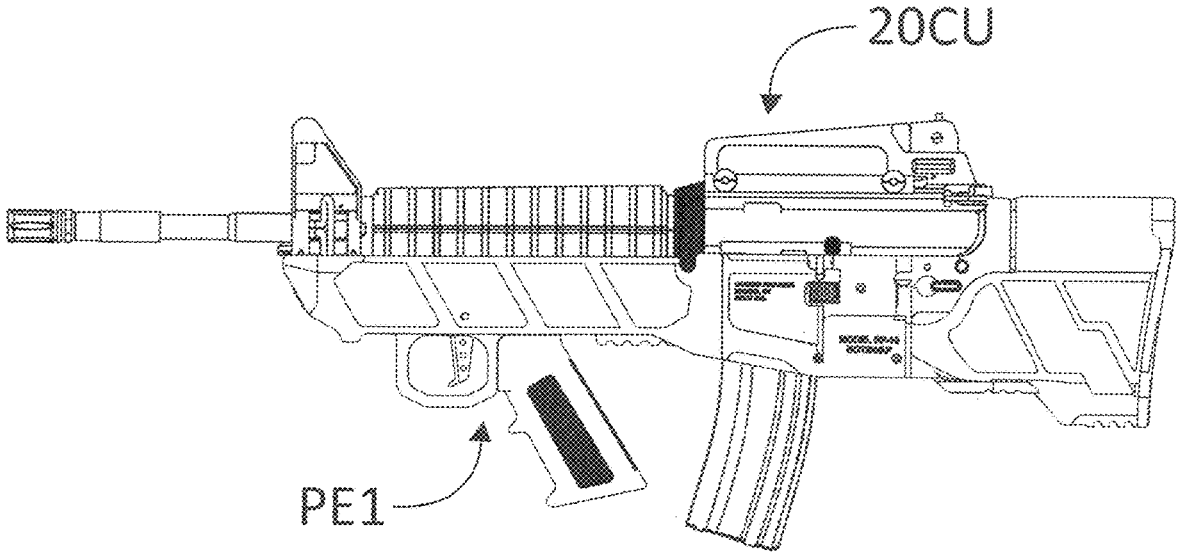
Figure 35:
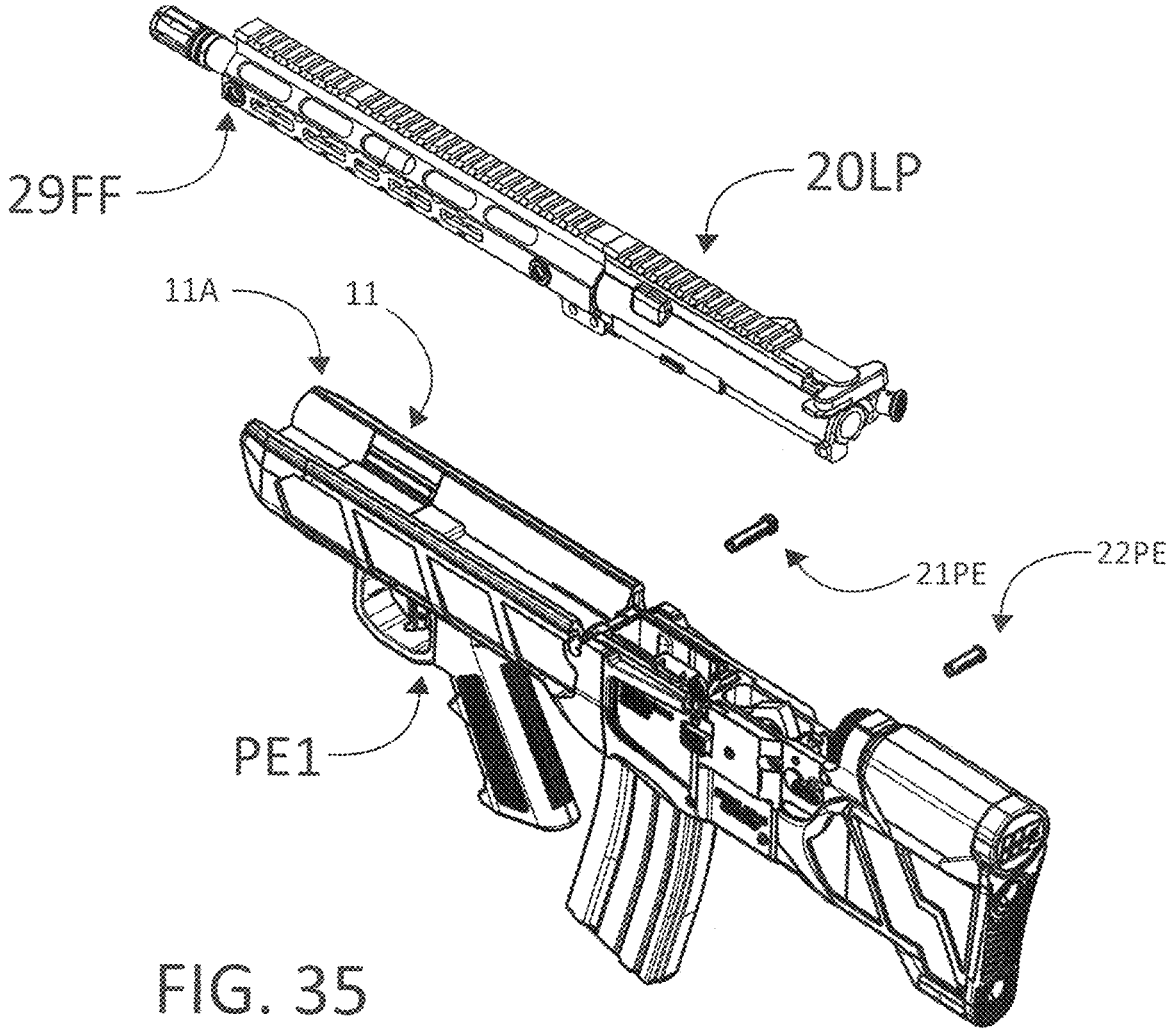
Figure 37:
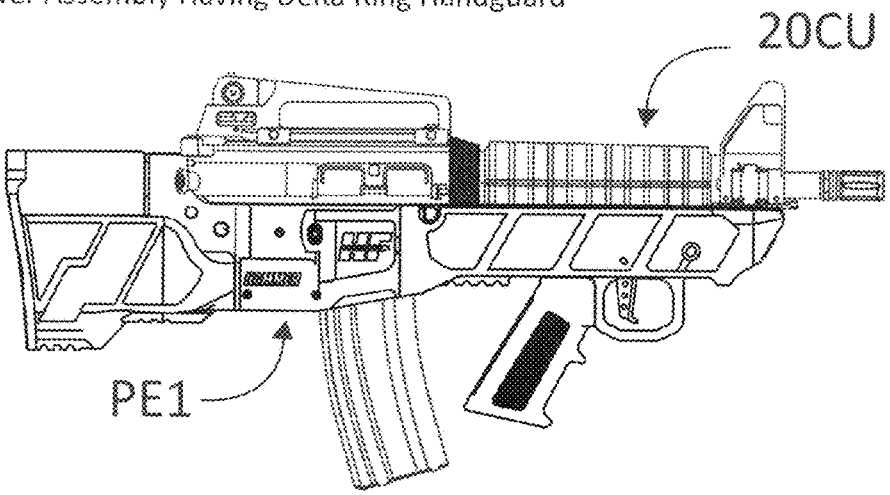

FIG. 25 is a left-side view of an AR-15 Bullpup Firearm resulting from rapid "Hot Swap" rapid conversion illustrated in FIG. 35, and FIG. 37.

Figure 26:
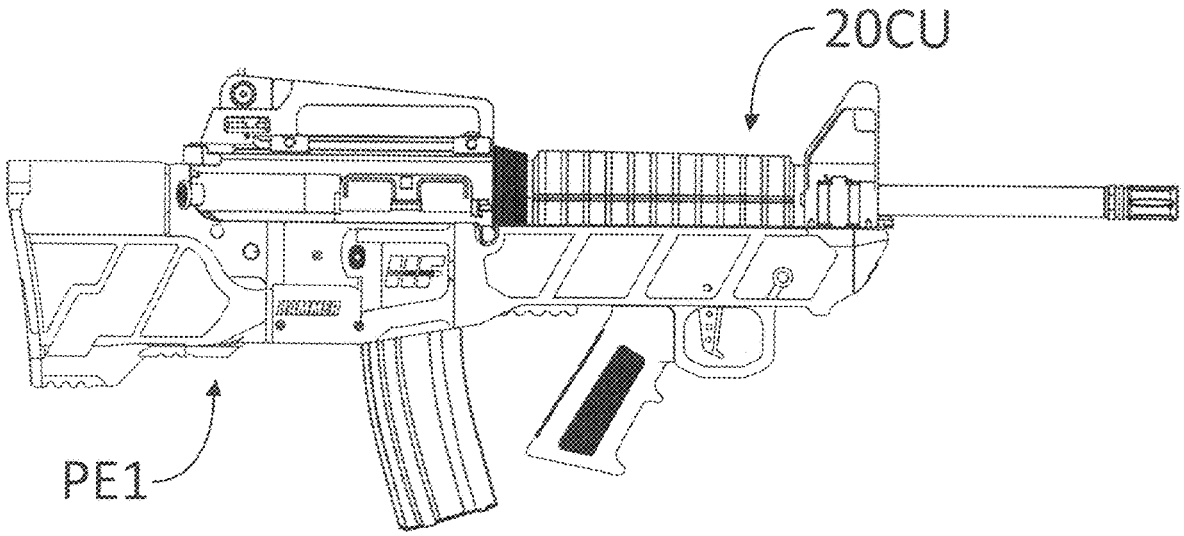

FIG. 26 is a right-side view of an AR-15 Bullpup Firearm resulting from the "Hot Swap" rapid conversion process illustrated in FIGS. 21 and 22 shown here with preferred embodiment PE 1.

Figure 27:
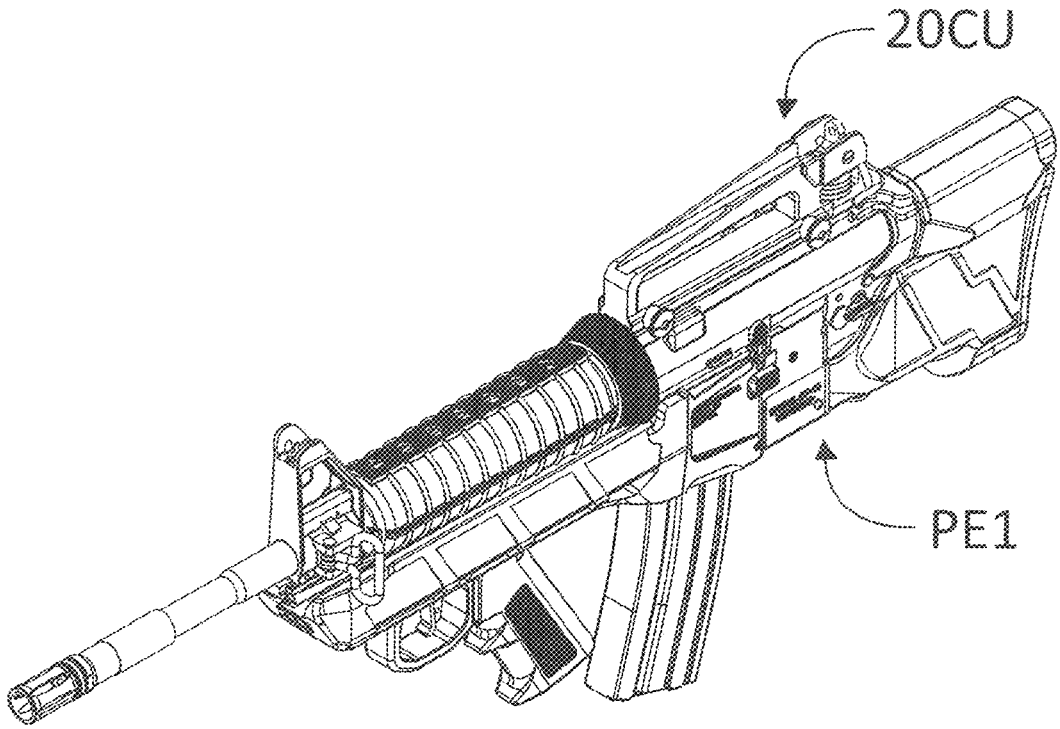

FIG. 27 is a front left-side elevational view of the same exemplary AR-15 Bullpup Firearm illustrated in FIG. 26.

Figure 28:
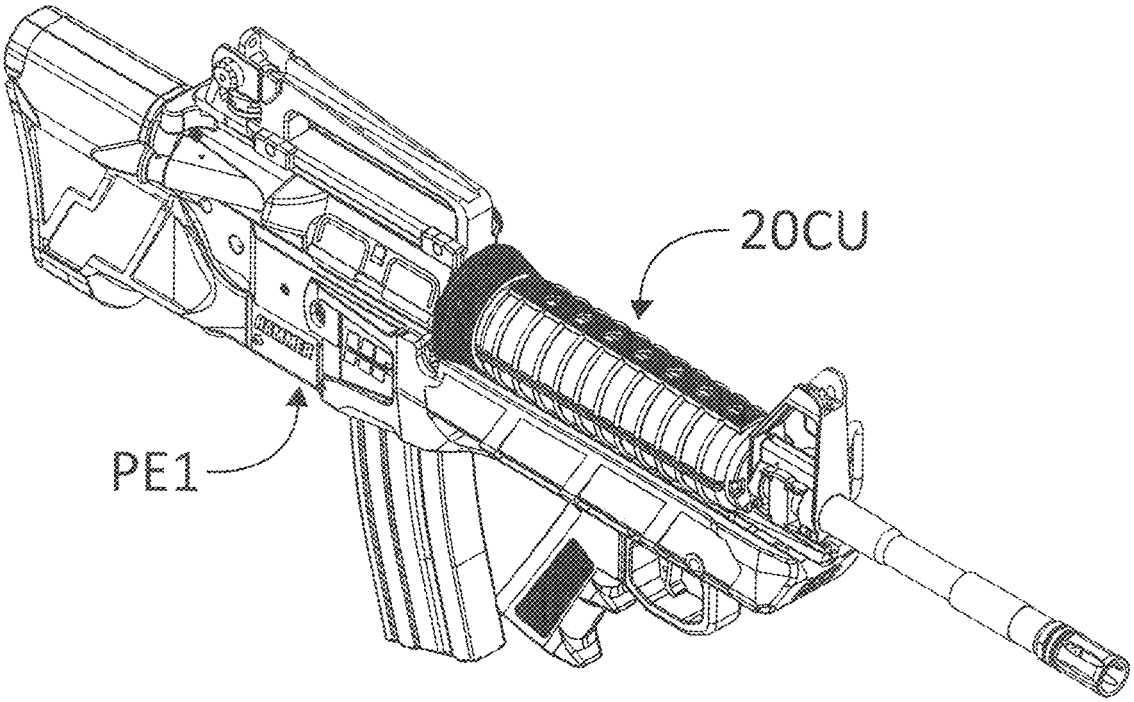

FIG. 28 is a front right-side elevational view of the same exemplary AR-15 Bullpup Firearm illustrated in FIG. 26 and FIG. 27.

Figure 29:
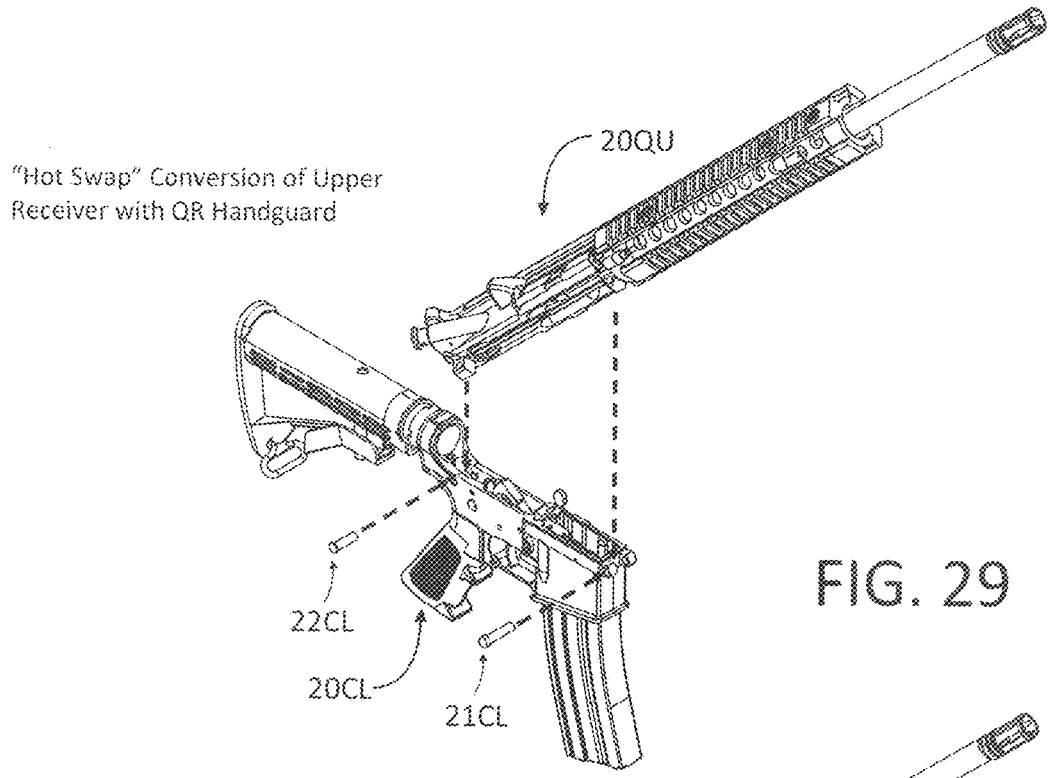

FIG. 29 illustrates the a "Hot Swap" rapid conversion" process illustrated in FIG. 21 and FIG. 22, but also illustrates the universal application of the present disclosure for use with a wide variety of different handguard systems employed in the upper receiver assembly. The illustration in FIG. 29 is shown with an upper receiver assembly having a floating (FF) handguard that is configured in quadrail (QR) style. FIG. 21 previously illustrated the same using a Conventional AR-Firearm A2 style gas block and delta-ring handguard. FIG. 29 is a front right-side elevational view that similarly illustrates the first step for rapid "Hot Swap" conversion of a Conventional AR-15 Type Firearm into an AR-15 Bullpup Firearm using the present disclosure (i.e., decoupling and removal of the upper receiver assembly from the lower receiver assembly of the Conventional AR-15 Type Firearm by retraction of the two captured coupling pins (i.e., a takedown pin and pivot pin collectively referred to as the "Receiver Pins") located in the lower receiver assembly of the Conventional AR-15 Type Firearm and lifting the upper receiver assembly away from the lower receiver assembly of the Conventional AR-15 Type Firearm).

Figure 30:
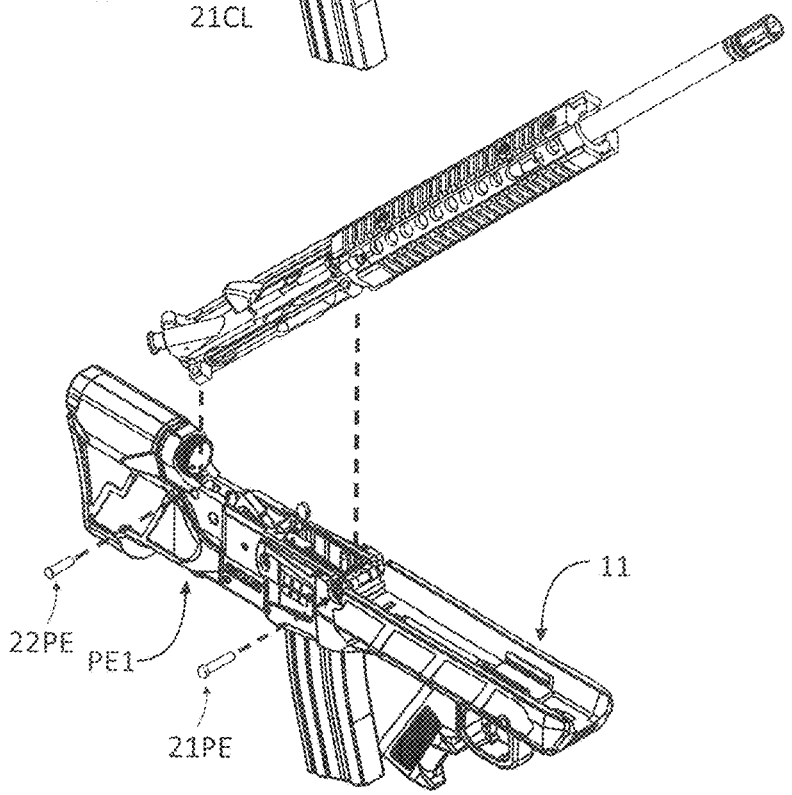

As was shown in FIG. 22 which illustrated the same using a Conventional AR-Firearm A2 style gas block and delta-ring handguard, FIG. 30 is a front right-side elevational view that similarly illustrates the second step for rapid "Hot Swap" conversion of a Conventional AR-15 Type Firearm into an AR-15 Bullpup Firearm using the present disclosure (i.e., placement of the upper receiver assembly removed from the Conventional AR-15 Type Firearm (the example here shown having a an FF handguard configured in a QR style onto the AR-15 Bullpup Lower Receiver Assembly (with preferred embodiment PE 1 shown) and coupling thereof by pushing in the two commonly located, captured Receiver Pins of the AR-15 Bullpup Lower Receiver Assembly.

Figure 31:
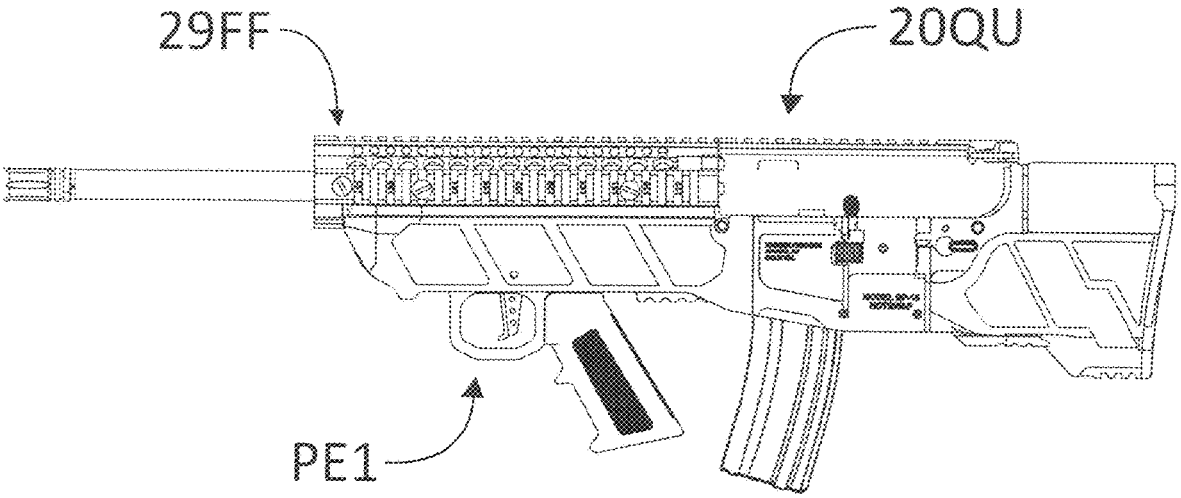

FIG. 31 is a left-side view of an AR-15 Bullpup Firearm with an upper receiver assembly from a Conventional AR-15 Type Firearm (pictured here having an FF handguard with a QR design attached to preferred embodiment PE1 of the AR-15 Bullpup Lower Receiver Assembly.

Figure 32:
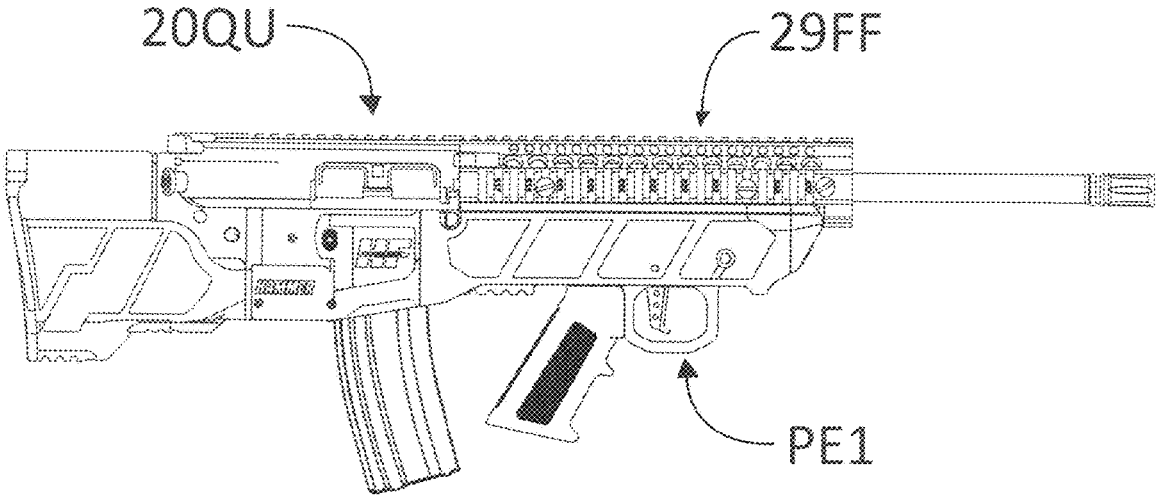

FIG. 32 is a right-side view of the AR-15 Bullpup Firearm pictured in FIG. 31.

Figure 33:
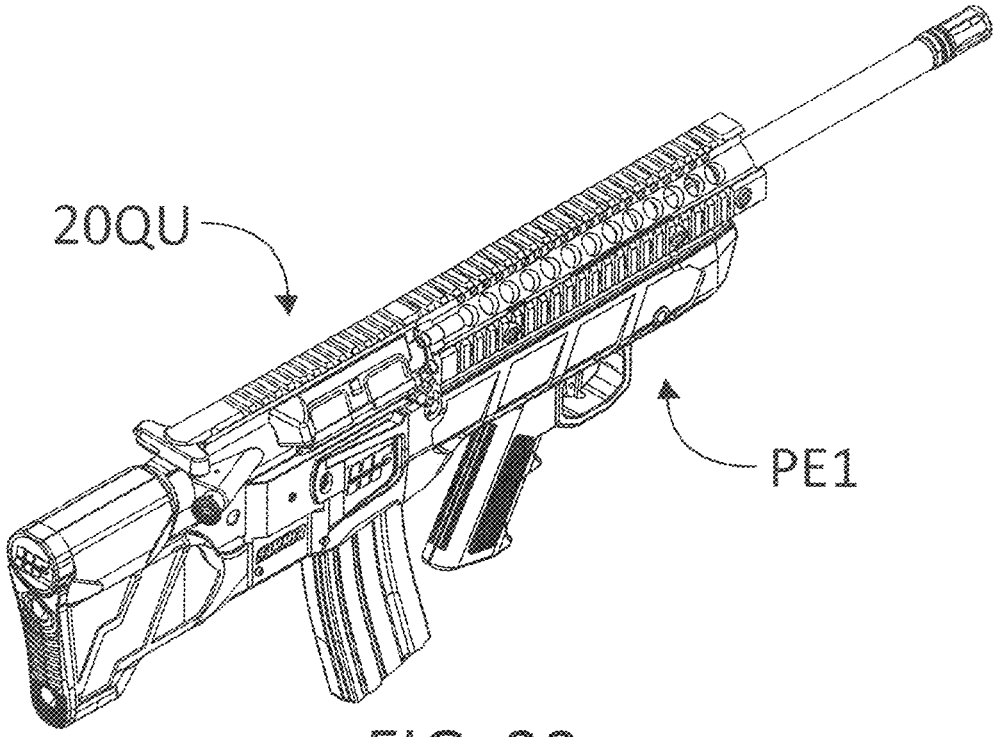

FIG. 33 is a rear right-side elevational view of the AR-15 Bullpup Firearm pictured in FIG. 31.

Figure 34:
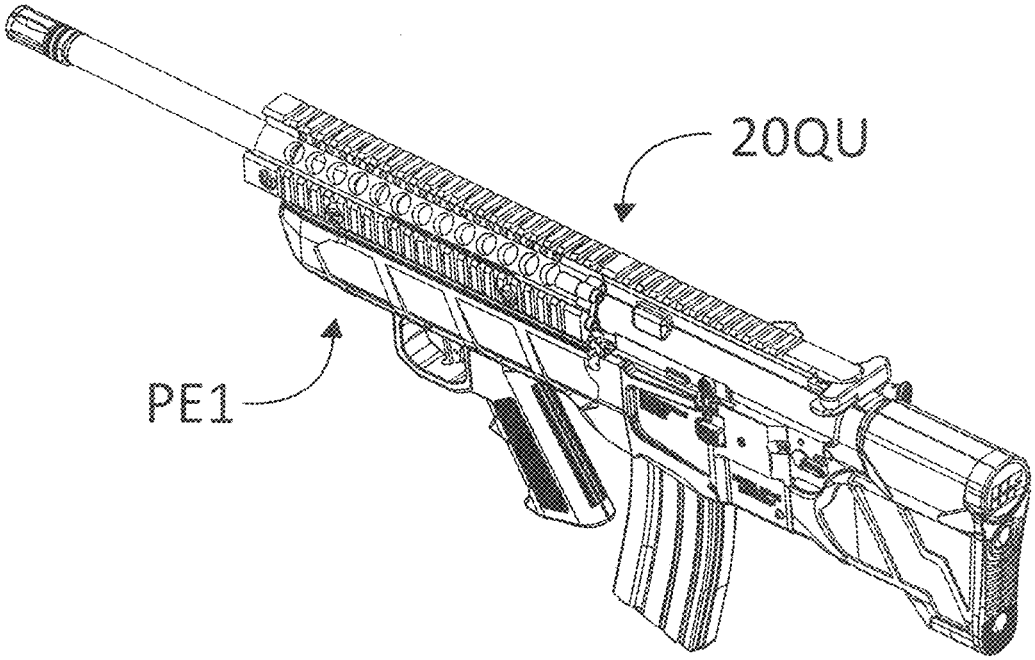

FIG. 34 is a rear left-side elevational view of the AR-15 Bullpup Firearm pictured in FIG. 31.

FIG. 35 further illustrates the universal application of the present disclosure regardless of the type of handguard, BCG or gas system employed in the upper receiver assembly. The upper receiver assembly depicted in FIG. 35 is an example of one of several Bufferless Upper Receiver Assemblies known in the art, each of which employs a proprietary Bufferless BCG, a piston-driven gas system and proprietary low profile (LP) style of floating handguard. As was previously illustrated in FIG. 22 (depicted with an upper receiver assembly having a DI Buffered BCG, A2 style gas block, DI gas system and delta-ring handguard) and in FIG. 30 (depicted with an FF handguard having a QR design), FIG. 35, is a front right-side elevational view that similarly illustrates the second step of "Hot Swap" rapid conversion of a Conventional AR-15 Type Firearm into an AR-15 Bullpup Firearm wherein a Bufferless Upper Receiver Assembly (having a Bufferless BCG and gas-piston system employed therein) is coupled with the preferred embodiment of the present disclosure (PE1).

Figure 36:
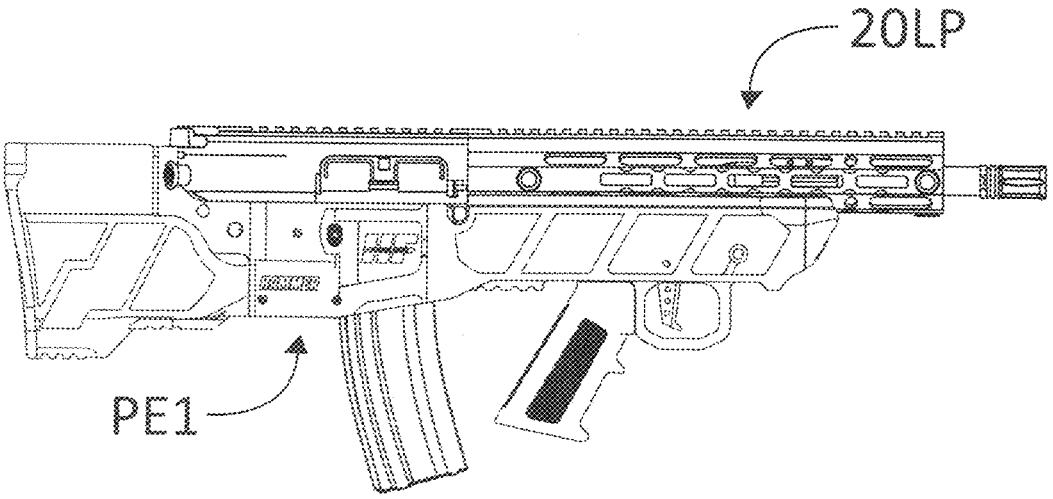

FIG. 36 is a right-side view illustrating the result of the second step for "Hot Swap" rapid conversion of a Conventional AR-15 Type Firearm into an AR-15 Bullpup Firearm using the preferred embodiment of the present disclosure (PE1). The example here shown having a proprietary Bufferless Upper Receiver Assembly employing a piston-driven gas system and Bufferless BCG is coupled to the AR-15 Bullpup Lower Receiver Assembly (with preferred embodiment PE 1 shown) and made operational by pushing in the two commonly located, captured Receiver Pins of the AR-15 Bullpup Lower Receiver Assembly.

FIG. 37 is a right-side view of an exemplary AR-15 Bullpup Firearm having an upper receiver assembly from a Conventional AR-15 Type Firearm that is configured as a short-barreled rife (SBR) having a 10.5" barrel, an A2 style gas block, and delta ring hand guard. This SBR-configured upper receiver assembly is) coupled with a preferred embodiment of the present disclosure ("PE1" and "AR-15 Bullpup Lower Receiver Assembly").

Figure 38:
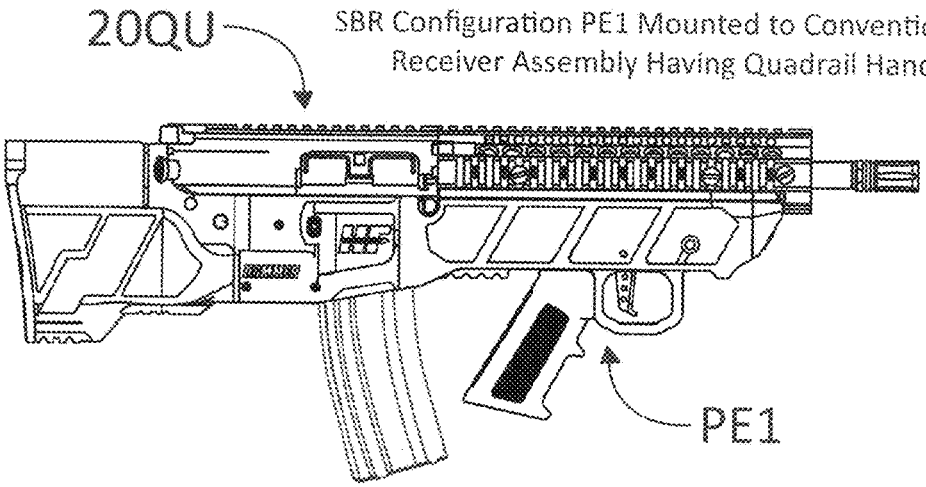

FIG. 38 is a right-side view of an exemplary AR-15 Bullpup Firearm configured as an SBR similar to the one illustrated in FIG. 37 but is illustrated here using an upper receiver assembly from a Conventional AR-15 Type Firearm having an FF handguard with a QR design. This SBR-configured upper receiver assembly is similarly coupled to a preferred embodiment of the present disclosure ("PE1" and "AR-15 Bullpup Lower Receiver Assembly").

FIG. 39 depicts prior art, specifically three "AR-15 Bullpup Conversion Kits" and AR-15 Bullpup Chassis" known in the art. This illustration is included to distinguish these parts kits and mere chassis form the present disclosure and make obvious the fact that the present disclosure is not a bullpup conversion kit or chassis, but rather is an AR-15 Bullpup Lower Receiver Assembly that includes a fully functioning bullpup-configured lower receiver (Bullpup Configured Lower Receiver).

The foregoing summary, as well as the following detailed description of the present disclosure, is better understood when read in conjunction with the appended drawings. For the purpose of illustrating the present disclosure, exemplary constructions of the preferred embodiment are shown in the drawings. However, the present disclosure is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF THE INVENTION

The field of invention of the present disclosure and claims thereof is expected to fall within one or more of the Cooperative Patent Classifications (CPC) F41A and F41C and related subclassification thereunder.

The drawings and detailed discussion provided herein are provided with reference to only selective and preferred embodiments of the present disclosure, specifically, an AR-15 Bullpup Lower Receiver Assembly intended to be used with AR-15 Type Firearms (AR-15 Bullpup Lower Receiver Assembly). Such exemplary embodiments do not describe all possible implementations of the Lower Receiver Assembly and are not intended to limit the scope of the present disclosure to exclude any of the numerous other embodiments of the present disclosure. Although the features of the present disclosure will be described with reference to the embodiments shown in the drawings herein, it will be understood by one of ordinary skill in the art will recognize that the described features can be embodied in many alternate forms of embodiments. In addition, any suitable size, shape or type of elements or materials could be used. Other objects and advantages of the present disclosure will become apparent to one knowledgeable in the art and science from the following description taken in connection with the accompanying drawings, wherein is set forth by way of illustration and example, embodiments of this invention.

This AR-15 Bullpup Lower Receiver Assembly described herein is equally applicable to all firearms in the family of AR-15 Type Firearms regardless of manufacturer, model, length of barrel, or the caliber of ammunition (e.g., AR-15, AR-9, AR-10, AR-12, and AR-22).

The development of AR-15 Bullpup Firearms known in the art have taken one of two distinct approaches: (1) AR-15 Caliber Bullpup Rifles (which are full-time bullpup configured rifles, although is a caliber of ammunition common to AR-15 Type Firearms, are not convertible into or usable in a conventional configuration, do not use a substantial amount of AR-15 Parts, and cannot be used with a lower receiver assembly of an AR-15 Type Firearm); or (2) AR-15 Bullpup Conversion Kits, which similarly yield a bullpup-only configured rifle and are parts kits containing several bullpup conversion parts that are by a firearm user onto their existing AR-15 Type Firearm.

Several examples of AR-15 Caliber Bullpup Rifles known in the art and/or currently sold in the U.S. are referenced above. Categorically, all known examples of AR-15 Caliber Bullpup Rifles share at least three common disadvantages which gives rise to the need for and benefits of the present disclosure: (1) AR-15 Caliber Bullpup Rifles utilize a proprietary BCG, upper receiver and/or other upper receiver assembly parts that are not interchangeable with AR-15 Parts, which generally makes these bullpup rifles significantly less affordable than comparably equipped Conventional AR-15 Type Firearms; (2) AR-15 Caliber Bullpup Rifles utilize proprietary lower receiver assembly parts that are not compatible with upper receiver assemblies found on most AR-15 Type Firearms; and (3) AR-15 Caliber Bullpup Rifles have a full-time bullpup configuration and cannot be used in a conventional configuration.

In stark contrast to AR-15 Caliber Bullpup Rifles, the AR-15 Bullpup Lower Receiver Assembly preferred embodiment of the present disclosure: (1) uses a substantial number of AR-15 Parts and does not require the firearm user to purchase any proprietary parts (which makes it far more affordable than AR-15 Caliber Bullpup Rifles); (2) is fully compatible with upper receiver assemblies of nearly all AR-15 Type Firearms; and (3) enables a rapid and bidirectional "Hot Swap" conversion that enables users of Conventional AR-15 Type Firearm simultaneous access and use of their firearm in either its conventional configuration or as a AR-15 Bullpup Firearm.

Other than AR-15 Bullpup Firearms, the only other approach known in the art to accomplish an AR-15 Bullpup Firearm is a method described herein as an AR-15 Bullpup Conversion Kit. See FIG. 39 for illustration and reference to three such examples. Each of the three referenced examples of the AR-15 Bullpup Conversion Kits known in the art has specific deficiencies and disadvantages not found in the AR-15 Bullpup Lower Receiver Assembly preferred embodiment of the present disclosure. Perhaps the biggest disadvantage AR-15 Bullpup Conversion Kits is that none of examples known in the art enables an owner of a conventionally configured AR-15 Type Firearm to rapidly convert an AR-15 Type Firearm from a conventional configuration to and from a bullpup configuration. Such rapid and bilateral conversion in configuration is rendered impossible by the inherent "kit" design approach common to all Bullpup Conversion Kits, including all AR-15 Bullpup Conversion Kits. Each such conversion "kit" requires a firearm user to attach and install several component parts onto their existing firearm using fasteners and tools in a process that takes several minutes to perform and yields a dedicated bullpup-only configuration. Additionally, such AR-15 Bullpup Conversion Kits are generally designed to be used only with host AR-15 Type Firearms having the specific type and shape lower receiver assembly for which the kit was designed.

The user-installed nature of AR-15 Bullpup Conversion Kits also poses some disadvantages as compared to the unified single unit assembly method adopted in the present disclosure. Some users of AR-15 Type Firearms, even those reasonably qualified to perform such installation, might be reluctant to take on such task. Moreover, these AR-15 Bullpup Conversion Kits all require the firearm user to install trigger component parts which generally must be adjusted during installation to conform to type and shape of the trigger bow used on the host AR-15 Type Firearm. User-required installation of trigger components invites installation variances and potential malfunctions that may be dangerous to the user.

With reference to FIGS. 1-3, the present disclosure is a system taking the form of a bullpup-configured lower receiver assembly having a unified single unit method of assembly (Bullpup Lower Receiver Assembly). The general object of the Bullpup Lower Receiver Assembly is twofold. By reference to the preferred embodiment ("AR-15 Bullpup Lower Receiver Assembly" and "PE1"), the general objective of the present disclosure is twofold:

Use by Existing Owners of Conventional AR-15 Type Firearms. The bullpup configured AR-15 Type Firearm (Bullpup AR-15 Type Firearm) is designed universally enable users of Conventional AR-15 Type Firearms to perform a "Hot Swap" rapid conversion of such Conventional AR-15 Type Firearm into a Bullpup AR-15 Type Firearm (and back to its configuration as a Conventional AR-15 Type Firearm) without the need for any tools, user installation of a bullpup conversion kit parts, or user-modification to the host upper receiver assembly. This conversion process can generally be completed by firearm users in a matter of seconds. Unlike AR-15 Bullpup Conversion Kits, the present disclosure is universally applicable for use with a wide variety of upper receiver assemblies commonly found in AR-15 Type Firearms and application and utility is NOT limited to only specified upper receiver assemblies or component parts thereof (e.g., upper receiver, bolt carrier group (BCG), gas system design, handguard type). The unique "Hot Swap" rapid conversion is also enabled by sizing and locating upper and lower receiver coupling in a manner that is fully compatible with same lower receiver of a Conventional AR-15 Type Firearm.

Use in manufacture of new AR-15 Type Firearms. The preferred embodiment of the present disclosure is also designed for use as a component part in the manufacturer of a complete firearm. In such case, the newly manufactured AR-15 Bullpup Firearm would include the AR-15 Bullpup Lower Receiver Assembly combined with any number of AR-15 Upper Receiver Assemblies selected by the manufacturer and/or desired by firearm purchasers. Such newly manufactured AR-15 Bullpup Firearms would also allow the purchaser to exchange and use the included AR-15 Bullpup Lower Receiver Assembly on another Conventional AR-15 Type Firearm owned by the purchaser.

Figure 4:
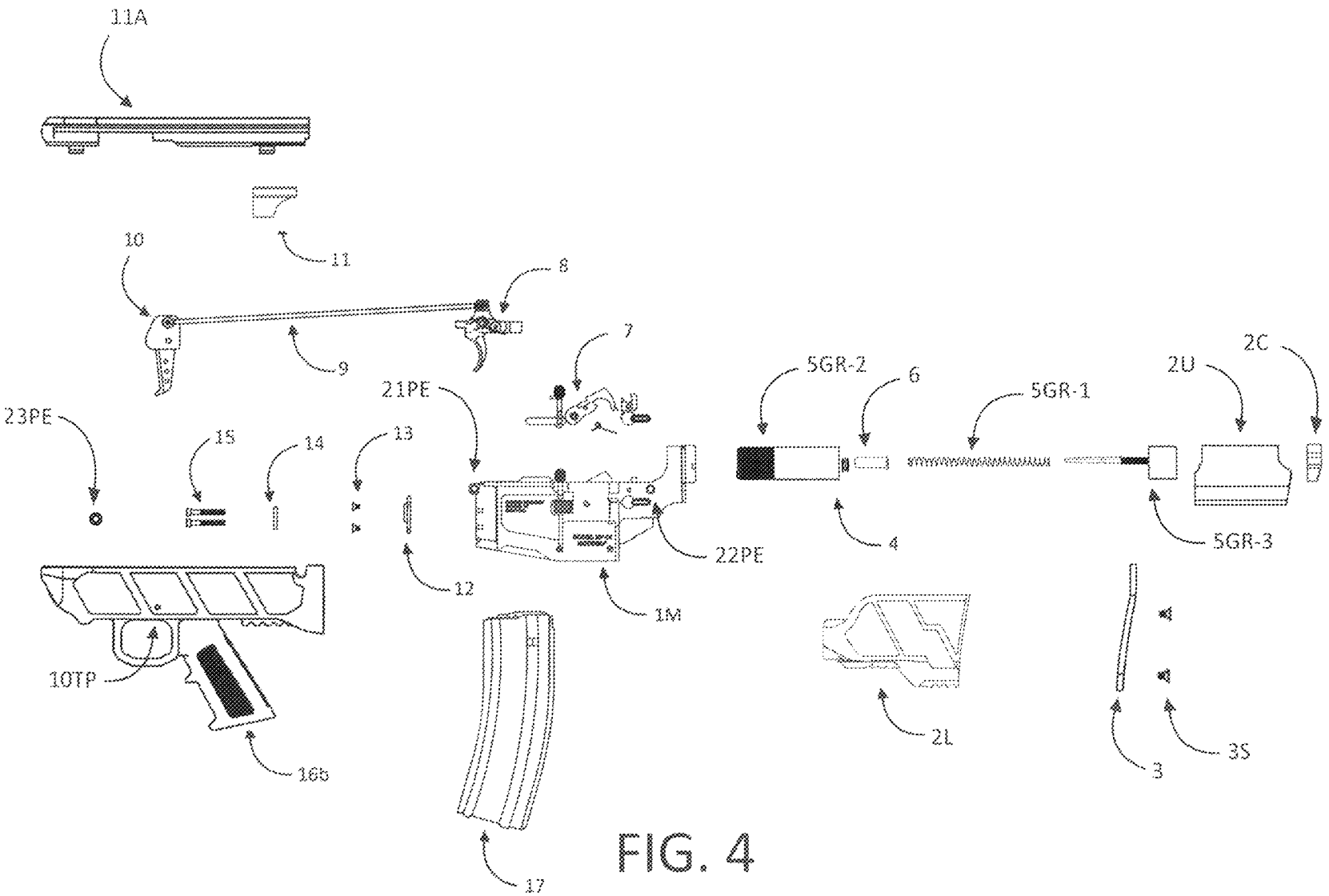
FIG. 4 is an exploded left-side view of significant component parts housed in the present disclosure embodiment illustrated in FIG. 1.
Figure 5:
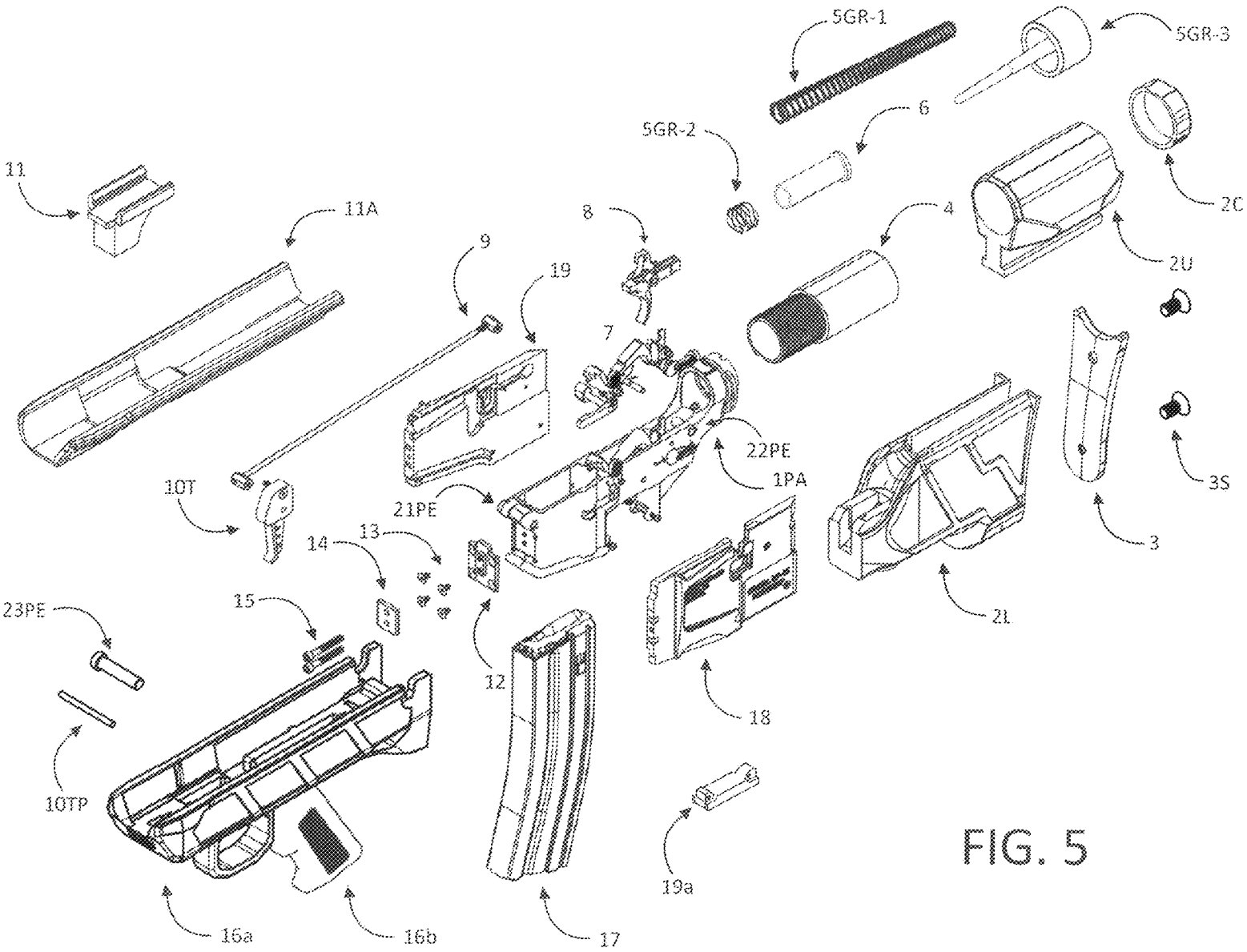
FIG. 5 is an exploded front left-side elevational view of significant component parts housed in the present disclosure embodiment illustrated in FIG. 1.
Figure 8:
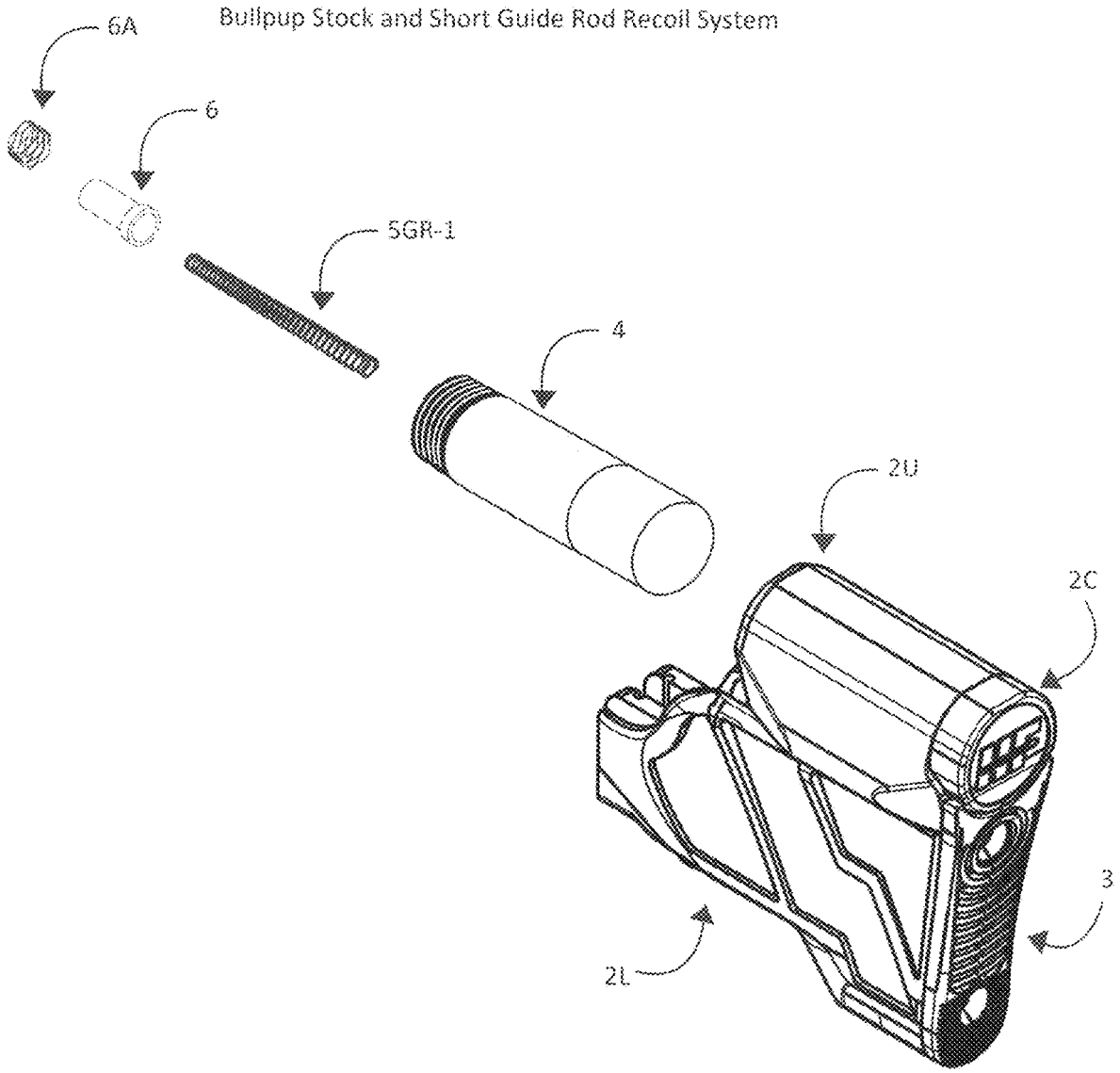
FIG. 8 is a rear left-side elevational view of an exemplary Bullpup Stock having an exemplary guide rod spring system housed therein.
Figure 9:
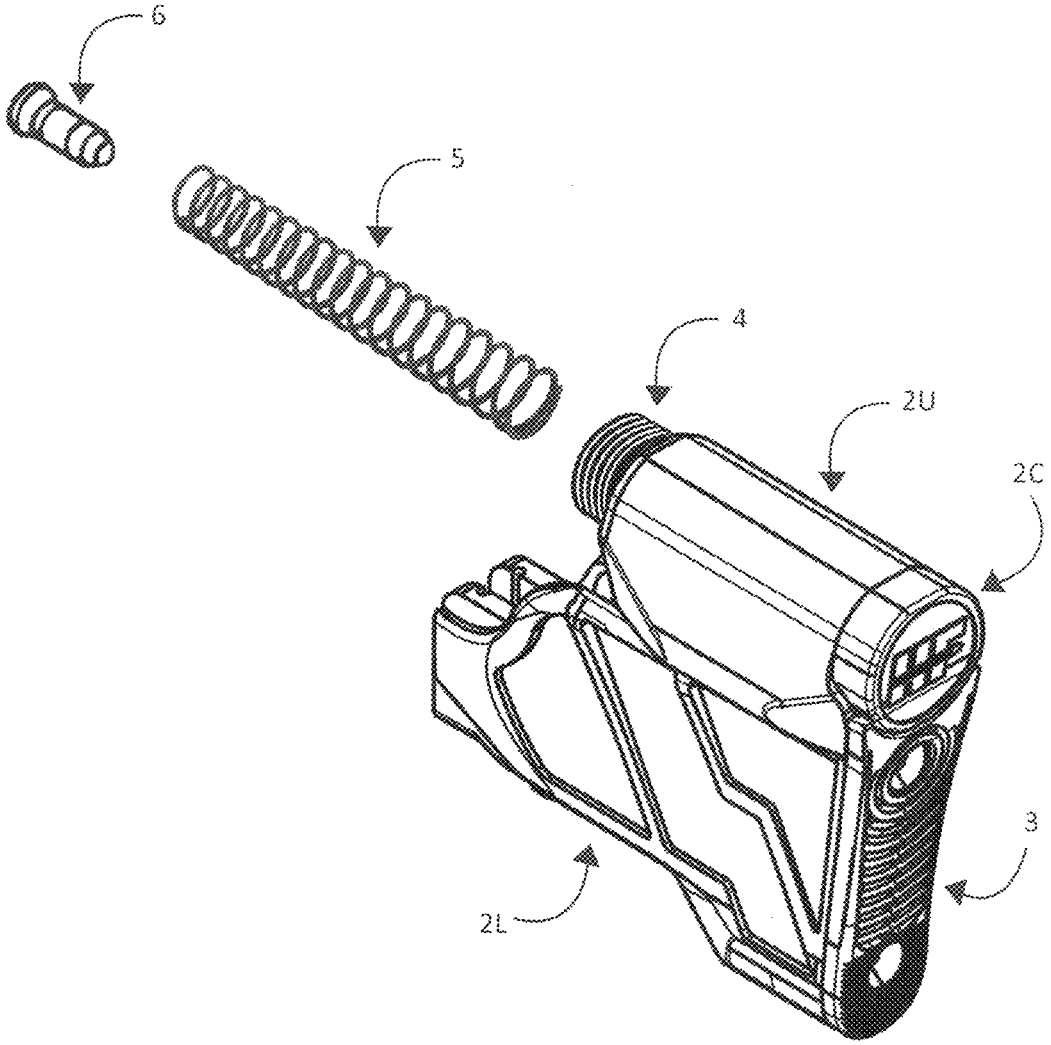
FIG. 9 is a rear left-side elevational view of an exemplary Bullpup Stock having an exemplary buffer recoil system housed therein.

With reference to FIGS. 1-3, one knowledgeable in the art will recognize that the Bullpup AR-15 Lower Assembly is assembled into a unified single unit during the manufacturing and production process, prior to the firearm user's receipt. With reference to FIGS. 4-5, one knowledgeable in the art will recognize that consists of several component parts therein, including, but not limited to the following: With reference to FIGS. 8-9, a specialized bullpup configured buttstock (Bullpup Buttstock) 2L, 2U, 2C, 3 and 3S, which includes an upper component 2U, which houses a buffer tube (receiver extension) 4 and a specialized recoil system (Short Buffer System) therein. 5GR-1, 5GR-2, 5GR-3 and 6 (FIG. 8) or alternatively 5,6 (FIG. 9). With reference to FIGS. 1-5, one knowledgeable in the art will recognize that the Bullpup Buttstock is located at the rear of the Bullpup AR-15 Lower Assembly and is connected to a specialized bullpup-configured lower receiver (Bullpup Configured Lower Receiver), 1PA or 1M, which houses a specialized bullpup-configured fire control unit (FCU) that includes a bullpup-configured trigger 7 that has a trigger tab protruding from the top, a Mil-spec hammer 8, trigger and hammer springs, trigger and hammer pins, and a safety selector mechanism. A threaded trigger tab located above the top end of the trigger 7 is connected to a trigger linkage bar 9 that travels forward into to a bullpup configured fore-end (Bullpup Fore-end) 16*a* until reaching the forward located trigger 10T therein. The Bullpup Fore-end 11*a* has an attached pistol grip 16*b*. The user activates the trigger 7 and releases the hammer 8 in the FCU by pulling and releasing the forward located trigger 10T located in the Bullpup Fore-end 16*a*.

With reference to FIGS. 1-3 (which illustrates the preferred embodiment PE1 of the present disclosure) and reference to the several different examples of upper receiver assemblies attached to PE1 illustrated in FIGS. 24, 26-28, 31-34, and 36-38, it will become apparent to one knowledgeable in the art that the present disclosure is a complete lower receiver assembly having a monolithic or unified single unit method of assembly thereof, and should further recognize that the incorporation of a lower receiver and single unit method of assembly is a novel and critical aspect of the present disclosure's ability to enable a rapid and bidirectional conversion from an Conventional AR-15 Type Firearm to an AR-15 Bullpup Firearm. This "Hot Swap" rapid conversion feature presents a practical means for a firearm user to contemporaneously operate their Conventional AR-15 Type Firearm in either its original conventional configuration or as AR-15 Bullpup Firearm by simply decoupling and recoupling a few captured pins.

With reference to FIG. 12 (which is a right-side elevational view of Conventional AR-15 Type Firearm after separating its upper receiver assembly 20CU from its conventionally configured lower receiver assembly CU) and FIGS. 21-22 and FIGS. 29-30 (which illustrate the two-step rapid and bidirectional "Hot Swap" process used to convert a Conventional AR-15 Type Firearm to an AR-15 Bullpup Firearm (and vice versa)), one of ordinary skill in the art will recognize that the "Hot Swap" rapid conversion enabled by the preferred embodiments of the present disclosure is further enabled by using the same captured receiver pins found on a Conventional AR-15 Type Firearms 21CL and 22CL and locating them in the identical location on the Bullpup AR-15 Lower Receiver 21PE and 22PE. Based on these illustrations and the summary descriptions related thereto, one of ordinary skill in the art will further recognize that the two-step process utilized to accomplish such rapid and bilateral "Hot Swap" conversion can likely be accomplished in a matter of seconds by any person with even a basic knowledge of the pertinent art and science in a matter without the use of tools and without any significant training or experimentation. One knowledgeable in the art will further understand that such rapid and bidirectional conversion is simply not possible with any other known method of converting a conventionally configured rifle to a bullpup configured rifle. Bullpup Conversion Kits, by definition, do not include a lower receiver, and all known Bullpup Conversion Kits, including all known AR-15 Bullpup Conversion Kits, require the firearm user to install of several component parts using fasteners and tools in a process that can take several minutes or even hours.

Referring now to FIG. 21 (which shows an elevated right ride view of the exemplary Conventional AR-15 Type Firearm with an upper receiver assembly that has a Mil-spec "A2 delta-ring" style handguard 20CU typically included as "original equipment" on many lower and moderate priced carbine rifle variants of AR-15 Type Firearms) and FIG. 22 (which show an AR-15 Type Firearm that has been "Hot Swap" converted to a bullpup configuration (AR-15 Bullpup Firearm) by means of the preferred embodiment AR-15 Bullpup Lower Receiver Assembly PE1), one of ordinary skill in the art will recognize that the precise conversion steps necessary to accomplish the rapid and bilateral "Hot Swap" conversion of a Conventional AR-15 Type Firearm into an AR-15 Bullpup Firearm, in approximately 10 seconds or less by means of the present disclosure.

Referring to FIG. 21, the first step of the "Hot Swap" bullpup conversion is to decouple the upper receiver assembly 20CU from the lower receiver assembly 20CL of the Conventional AR-15 Type Firearm by pulling outward on the captured pivot pin 21CL and captured takedown pin 22CL attached to the takedown pin housing and pivot pin housing, respectively, of the lower receiver assembly 20CL and then pulling the takedown pin lug and pivot pin lug on the upper receiver assembly 20CU away from the takedown pin housing and pivot pin housing on the lower receiver assembly 20CL. The fore-end attachment piece (FAP) 11 should located in place in the Bullpup Fore-end 16*a* and retained by the captured FAP pin 23PE The upper receiver assembly 20CU in the clearly delineated position shown in FIG. 22 is then placed into the Bullpup Fore-end 16*a* as depicted in FIG. 22.

Referring now to FIG. 22, the second and final step of the "Hot Swap" conversion is to couple the upper receiver assembly of the conventionally configured AR-15 Type Firearm 20CU to the AR-15 Bullpup Lower Receiver Assembly PE1 by placing the upper receiver assembly 20CU onto the AR15 AR-15 Bullpup Lower Receiver Assembly PE1 such that the takedown pin lug and pivot pin lug on the upper receiver assembly 20CU are aligned with the openings in the takedown pin housing and pivot pin housing, respectively, which are located on the preferred embodiment AR-15 Bullpup Lower Receiver Assembly PE1 in the identical position as the takedown pin housing and pivot pin housing on the lower receiver assembly 20CL. The coupling of the conventionally configured upper receiver assembly 20CU and preferred embodiment AR-15 Bullpup Lower Receiver Assembly PE1 is completed by pushing in the captured FAP pin 23PE on the bullpup fore-end 16*a* as well as the captured pivot pin 21PE and captured takedown pin 22PE on the AR-15 Bullpup Lower Receiver Assembly PE1, which are attached to their respective housings in the identical location as that on the conventionally configured lower receiver assembly 20CL. The AR-15 Bullpup Firearm is thereafter operational. Conversion of the AR-15 Bullpup Firearm back into the original Conventional AR-15 Type Firearm is accomplished in approximately 10 seconds or less by performing the above three conversion steps in reverse.

With reference to FIGS. 21-22 and FIGS. 29-30, one knowledgeable in the art will recognize that the "Hot Swap" rapid conversion enabled by the AR-15 Bullpup Lower Receiver Assembly can generally be performed in a matter of seconds without any the use of any tools and without the need of any assembly or installation of component parts or fasteners by the firearm user.

With reference to FIGS. 1-9, the AR-15 Bullpup Lower Receiver Assembly pictured therein is preferred embodiment PE1. With reference to FIG. 8 and FIG. 9, which illustrate the Bullpup Buttstock comprised of upper recoil component housing parts 2U and 2C and a lower stock component part 2L. The upper component part 2U houses a Short Buffer System that includes a specialized buffer tube 4 and a specialized recoil mechanism (5GR-1, 6, and 6A in FIGS. 8 and 5 and 7 in FIG. 9).

With reference to FIGS. 4, 5, 8 and 9, one knowledgeable in the art will recognize that the front top portion of the lower component 2L of the Bullpup Buttstock is patterned after an AR-15 grip and thereby fastens to the grip attachment portion located at the bottom rear of the AR-15 Bullpup Lower Receiver, either 1PA or 1M. The front of the top piece of the Bullpup Buttstock 2U slides onto the buffer tube. In the Monolithic AR-15 Bullpup Lower Receiver Assembly embodiment of the present disclosure, the Bullpup Buttstock and the Bullpup Lower Receiver are combined into a single monolithic unit. In any event, a buttstock pad 3 made of rubber, silicone or similar material is fastened to the back of the upper 2U and lower component 2L of the Bullpup Buttstock.

With reference to FIGS. 4 and 5, it is noted that all embodiments of the AR-15 Bullpup Lower Receiver Assembly include a Bullpup Configured Lower Receiver. With reference to FIG. 4 (a monolithic embodiment 1M is shown. With reference to FIG. 5, a non-monolithic embodiment 1PA is shown in FIG. 5), which houses AR-15 Mil-spec FCU 7 that has been modified to accommodate a bullpup configuration. Unlike the monolithic (Monolithic Bullpup AR-15 Lower Receiver) illustrated in FIG. 4, the embodiment of the Bullpup Configured Lower Receiver illustrated in FIG. 5 is an aluminum or polymer Mil-spec lower receiver 1PA that has been adapted to a bullpup configuration and is encased by bullpup lower receiver plates. A left side plate 18 encloses the lower receiver on the left side, a right-side plate 19 encloses the lower receiver on the right side, and a bottom plate 19*a* connects the two side plates and encloses the lower receiver on the bottom. In one embodiment, the left side plate 18, right side plate 19, and bottom plate 19*a* may be fastened to aluminum Mil-spec lower receiver with machine screws. In yet another preferred embodiment of the present disclosure, the lower receiver 1PA and all bullpup plates 18, 19, and 19*a* combined into a single monolithic unit 1M (Monolithic Bullpup Lower Receiver). In any event, any embodiment having of a lower receiver having all bullpup lower receiver plates fastened or integrated thereto (Bullpup Configured Lower Receiver).

With reference to the FIGS. 22, 30, and 35, one knowledgeable in the art will recognize that the Bullpup Fore-end 16*a* is designed in a manner, and can be adapted with component removable parts 11 and 11A, to enable raid and universal coupling of the AR-15 Bullpup Lower Receiver Assembly to a plurality of upper receiver assemblies typically found on AR-15 Type Firearms currently in circulation in the U.S., regardless of the type, shape, or size of the handguard on upper receiver type of gas system utilized on upper receiver assembly of the host AR-15 Type Firearm. See FIGS. 23-28 and FIGS. 31-38.

With reference to FIGS. 16, 18-19, (26), FIG. 18 (26P) and FIG. 19 (26B), one skilled the art will recognize that the present disclosure can be used with upper receiver assemblies that employ any type of BCG or gas system (e.g., upper receiver assemblies that employ either DI Buffered BCG 26 or a Piston-Driven BCG 26P and Bufferless Upper Receiver Assemblies employing Bufferless BCGs 26B. Use of the preferred embodiment PE1 with a Bufferless Upper Receiver Assembly is accomplished by simply unscrewing the endcap 2C and the and removing the Short Buffer System recoil mechanism 5GR-1, 5GR-2, 5 GR-3 and 6 (FIG. 8) or alternatively 5,6 (FIG. 9) from the Bullpup Buttstock of the present disclosure (which takes mere seconds to perform). Bufferless Upper Receiver Assemblies incorporate a guide rod and spring recoil systems which negates the need for any recoil mechanism in attached lower receiver assembly.

Figure 13:
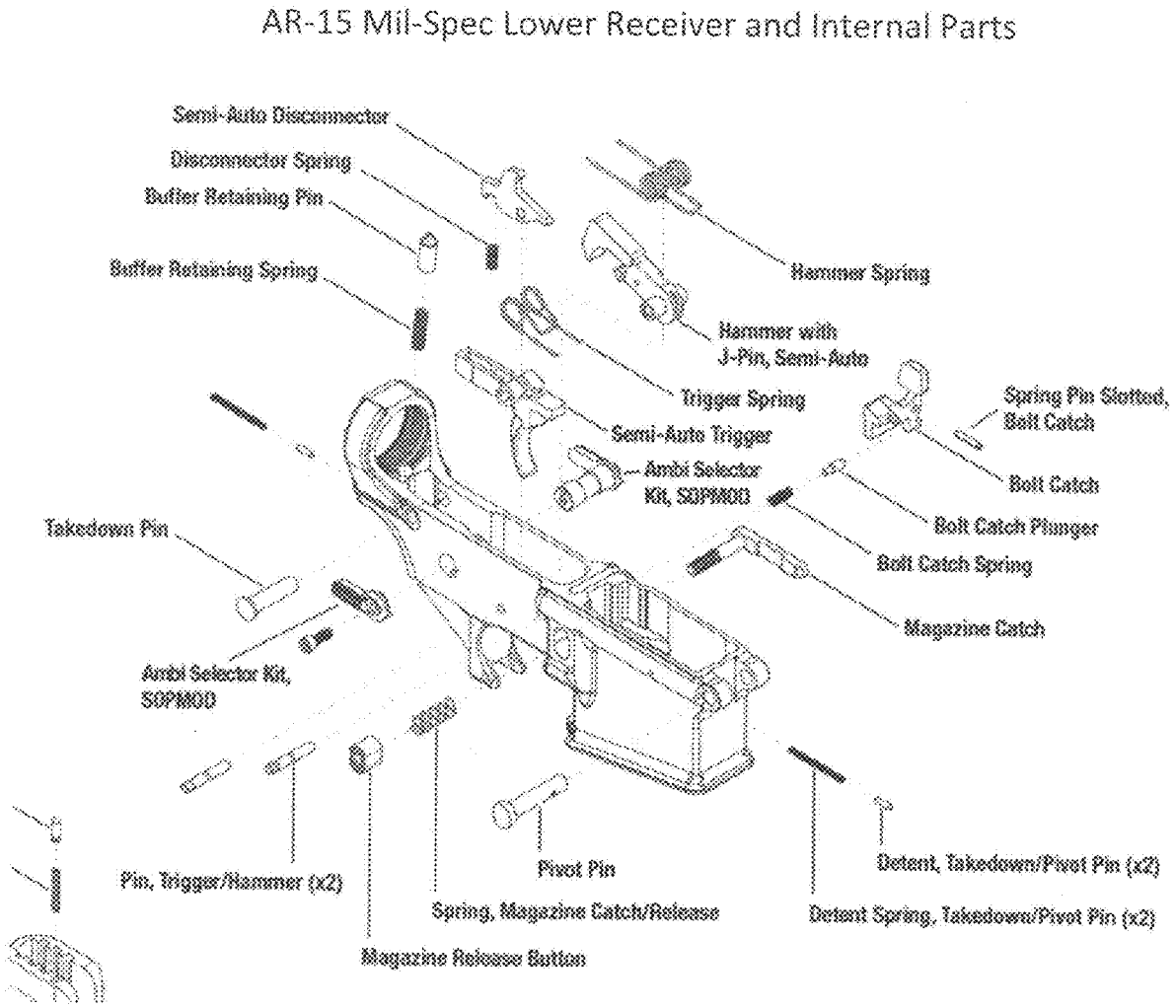
FIG. 13 (Prior Art)
FIG. 13 is prior art and is a front right-side elevational view of exemplary Mil-Spec lower receiver typically used in a Conventional AR-15 Type Firearm, including the component parts typically housed therein.

With reference to FIG. 4, in one of the preferred embodiments of the AR-15 Bullpup Lower Receiver Assembly, the Bullpup Configured Lower Receiver is of a monolithic design whereby the Bullpup Configured Lower Receiver 1PA, left side plate 18, right side plate 19, and bottom plate 19*a* are unified into a single monolithic unit 1M (Monolithic Bullpup Lower Receiver), which may made aluminum, polymer, or other material. In another embodiment of the present disclosure, the Monolithic Bullpup Lower Receiver may be further combined with the bullpup fore-end 16*a* into a single monolithic unit (Partially Monolithic AR-15 Bullpup Lower Receiver Assembly). In yet another embodiment of the present disclosure, the Monolithic Bullpup Lower Receiver 1M and bullpup fore-end 16*a*, may be further combined with the bullpup buttstock 3 and 4 into a single monolithic unit (Monolithic AR-15 Bullpup Lower Receiver Assembly). With reference to FIG. 13, it is noted that the Bullpup AR-15 Lower Receiver in all AR-15 Bullpup Lower Receiver embodiments of the present disclosure utilize several of the widely available AR-15 lower receiver internal parts commonly found the lower receiver assembly of most AR-15 Type Firearms.

With reference to FIG. 5 and FIG. 13, one of ordinary skill the art will recognize that a Mil-Spec lower receiver has been modified into a bullpup configuration 1PA and also that a significant number of the widely available and cost-efficient Mil-spec lower receiver component parts shown in FIG. 13 are also utilized in the preferred embodiments of the present disclosure applicable to AR-15 Type Firearms.

Figure 6:
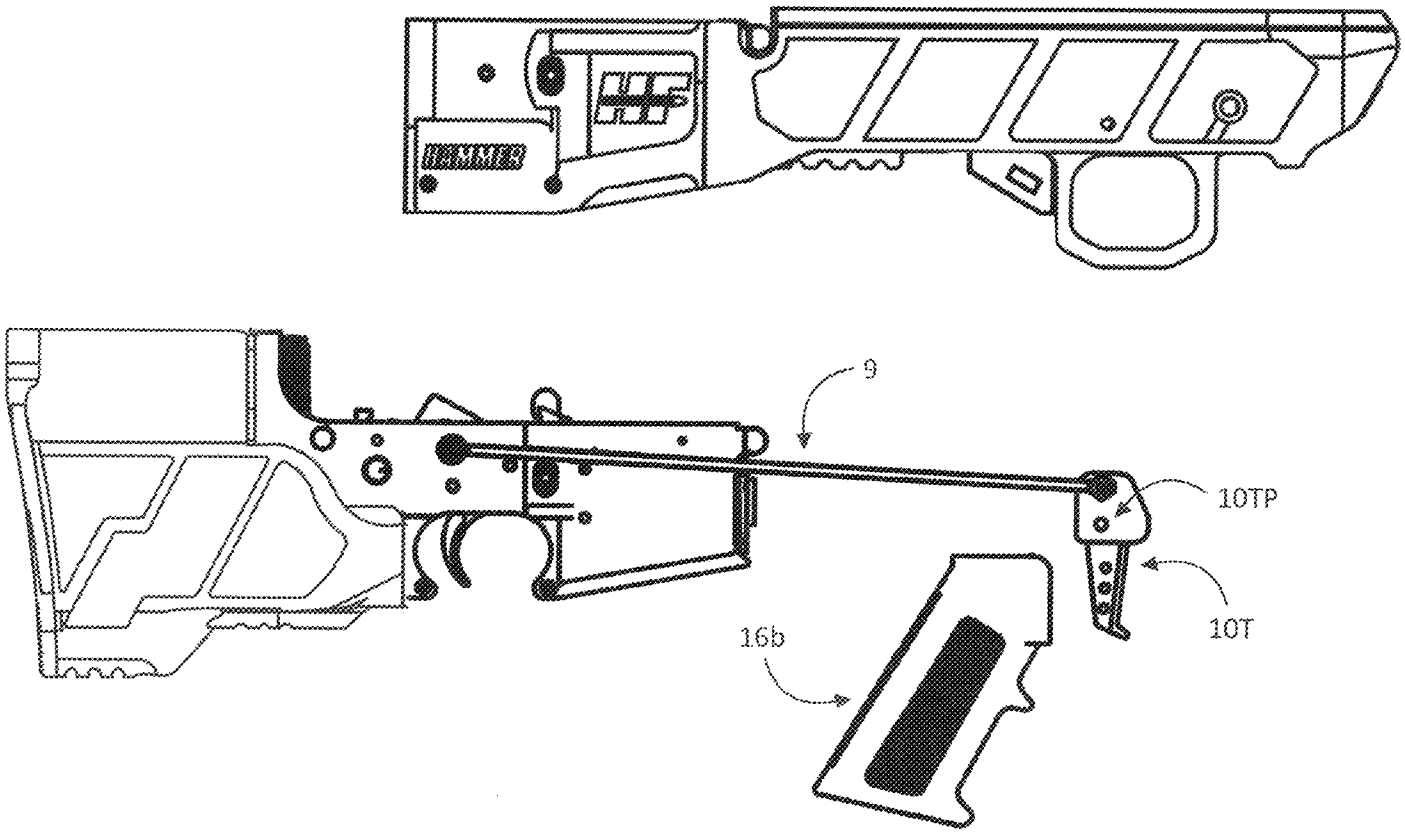
FIG. 6 is an exploded right-side view illustrating the routing of the trigger and trigger linkage system in the present disclosure embodiment illustrated in FIG. 1.
Figure 7:
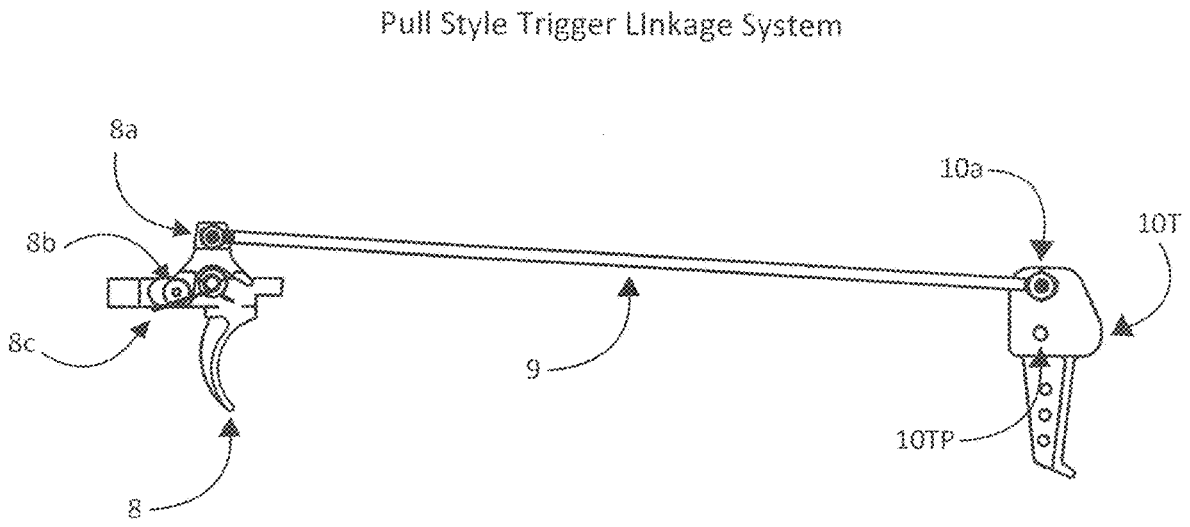
FIG. 7 is a right-side perspective of the trigger and trigger linkage system housed in the present disclosure embodiment illustrated in FIG. 1 and previously illustrated in FIG. 6.

With reference to FIG. 6 (which shows a preferred embodiment PE1 of the present disclosure with a lower receiver 1PA having the lower receiver side plates 18 and 19 and Bullpup Fore-end 16*a* removed to illustrate the "levered pull system," and relatively high path of the bullpup trigger linkage bar 9, which connects to the trigger 8 housed in the Bullpup Configured Lower Receiver at the rear and travels forward inside of the Bullpup Configured Lower Receiver and then into the bullpup fore-end 16*a* (which has an attached pistol grip 16*b*). The trigger bar 9 couples with the bullpup front trigger assembly 10 (which includes trigger 10T and trigger axis pin 10TP) housed therein. Referring now to FIG. 7, there is shown is a right-side isolated view of the trigger assembly 8 located in the Bullpup Configured Lower Receiver, bullpup trigger linkage bar 9, and bullpup trigger assembly 10 (collectively, the "trigger relocation assembly" or "Pull Style Trigger Linkage System") of all AR-15 Bullpup Lower Receiver Assembly embodiments of the present disclosure.

The preferred embodiments of the present disclosure, including PE1, is designed to address and resolve each of the aforementioned limitations and deficiencies associated with the Push Style Trigger Linkage Systems used in AR-15 Bullpup Conversion Kits. With reference to FIGS. 6-7, the Push Style Trigger Linkage System utilized in each of these preferred embodiments is specifically engineered and integrated into the AR-15 Bullpup Lower Receiver Assembly PE1 and includes a trigger linkage rod or bar 9 that is coupled in the front to a levered front bullpup trigger 10T which rotates on a trigger pin 10TP, both of which are housed in the bullpup fore-end 16*a*. At the rear, the trigger linkage rod or bar 9 is coupled to the specialized bullpup levered rear trigger 8, 8*a*, 8*b*, an 8*c* in the housed in the FCU, which also houses a trigger 7. This Pull Style Trigger Linkage System used in the preferred embodiment (PE1) is far more efficient and travels on a relatively higher path (See FIG. 6) than the Push Style Trigger Linkage Systems used in the trigger relocation assembly of all AR-15 Bullpup Conversion Kits known in the art. Referring now to FIG. 6 and FIG. 7, one of ordinary skill in the art will recognize that this is an illustration of the component parts of the trigger relocation assembly that is the levered Pull Style Trigger Linkage System employed in the preferred embodiments of the present disclosure and the method used therein. With reference to FIG. 7, the trigger 8, located in the fire control unit (FCU) housed in the Bullpup Lower Receiver 1PA or 1M, rotates freely on a trigger pin (when the safety of the FCU is set to "Fire") and is activated by means of the levered trigger axis tab 8*a* located its top end which is coupled to a trigger linkage rod or bar 9 which extends into the Bullpup Fore-end 16*a* and is therein coupled to a similarly levered trigger axis tab at the top of the front bullpup trigger 10T located in the Bullpup Fore-end 16*a*. The front bullpup trigger 10T rotates freely on a trigger pin. 10TP. When the front bullpup trigger 10T is pulled by the firearm user (and the FCU safety is set to "Safe"), the trigger 8 in the FCU is activated, which releases the hammer 7 located therein which strikes the firing pin within the BCG to discharge the ammunition round loaded into the firearm chamber.

In stark contrast to the Pull Style Trigger Linkage System employed as a trigger relocation assembly in the preferred embodiment, all AR-15 Bullpup Conversion Kits known in the art utilize a Push Style Trigger Linkage System which actuates the firing control group by means of a bushing abutting the front of the trigger bow in the FCU of the lower receiver of the AR-15 Type Firearm which pushes this FCU trigger when the front trigger is actuated. Such Push Style Trigger Linkage Systems have several inefficiencies and functional disadvantages as compared to the Pull Style Trigger System. However, because all Bullpup Conversion Kits, including all AR-15 Bullpup Conversion Kits, by definition, do not include or incorporate a lower receiver and are not designed in a unified single unit assembly, the use of a Pull Style Trigger Linkage System is simply not possible. The use of any trigger linkage systems utilized in AR-15 Bullpup Conversion Kits must be installed and adjusted by the firearm user, which requires the use of tools and a significant degree of firearm knowledge and gunsmithing skills. The requirement of Firearm user installation and adjustment of the bushing abutting the front of the trigger bow of the FCU trigger used in the Push Style Trigger Linkage Systems of the trigger relocation assemblies employed of all such AR-15 Bullpup Conversion kits is inherently susceptible to user installation and adjustment error and can often result in accidental discharge of the firearm. This issue is exacerbated by wide variation in the type, shape of the trigger bow, and trigger pull weight of the FCU triggers of host AR-15 Type Firearm to which the AR-15 Bullpup Conversion Kit is attached. AR-15 Bullpup Conversion Kits also typically employ a two-safety system. Many firearm users have publicly reported a strong disfavor of such two-safety system due to the unnecessary complication and confusion it creates. The present disclosure utilizes a single safety selector which is a Mil-spec configuration and is installed in the sidewall of the lower receiver and is position directly below the FCU trigger. The rearward-positioned safety selector utilized in most AR-15 Bullpup Conversion Kits is typically of a similar design. However, the literature provided by manufacturers of such AR-15 Bullpup Kits often recommends that firearm user's disfavor of the two-trigger system be resolved by removing the rearward-positioned safety selector and thereafter utilized solely the remaining frontward-positioned safety selector. As acknowledged (with an attempted liability disclaimer) in the literature provided by the manufacturer one such AR-15 Bullpup Conversion Kit in circulation (and noted in blogs by firearm users with respect to the other AR-15 Bullpup Conversion Kit in circulation), the removal of the rear safety selector can result in the unsafe condition and accidental discharge due to inability of the trigger linkage bushing located in front of the FCU trigger bow being able to prevent the such FCU trigger from traveling rearward when the weapon is bumped. The trigger pull assistance spring (designed to reduce trigger pull weight) utilized in the trigger relocation assembly of one such AR-15 Bullpup Conversion Kits currently in circulation further exacerbates such risk of such accidental discharge upon bumping (or upon mere repositioning of the rear-ward positioned safety selector from the "Safe" to "Fire" position).

Referring now to FIG. 4, FIG. 5 and FIG. 6, the Bullpup Fore-end 16*a* is connected to the Bullpup Configured Lower Receiver 1PA or 1M with attachment hardware 12-15. In the embodiment of the present disclosure utilizing a Monolithic Bullpup Lower Receiver 1M, certain of the attachment hardware 12 is integrated into the monolithic lower receiver 1M. A fore-end attachment piece (FAP) 11 connects the handguard of the lower receiver assembly of the host AR-15 Type Firearm to the bullpup fore-end using a captured pin 23PE located on the right front side of the bullpup-forend 16*a*.

Referring now to FIG. 16, one of ordinary skill in the art will recognize the example of a standard DI Buffered BCG 26 most commonly used in most AR-15 Type Firearms. These DI Buffered BCGs require an upper receiver assembly that utilizes a DI gas system. Similarly, with reference to FIG. 18, one of ordinary skill in the art will recognize the example of Piston-Driven BCGs 26P. which is designed for use with an AR-15 Type Firearm having a piston-driven gas system. With reference to FIG. 19, one knowledgeable in the art will recognize an example of a Bufferless Upper Receiver 20BU and accompanying Bufferless BCG 26B housed therein. Preferred embodiment PE1 is designed in a manner to enable use and safe operation with any of these BCGs and gas systems. In stark contrast, all known examples of AR-15 Caliber Bullpup require the use of a proprietary upper receiver assembly and BCG and all known examples of AR-15 Bullpup Conversion Kits require use of a specific or proprietary BCG (and also often use of a specific type or size of other upper receiver assembly components).

Referring now to FIG. 14 (which show the major components of an upper receiver assembly of an AR-15 Type Firearm), one knowledgeable in the art will recognize the various component parts typically found in the upper receiver assembly of an Conventional AR-15 Type Firearm 20CU and will further recognize that, the preferred embodiment PE1 of the AR-15 Bullpup Lower Receiver Assembly is designed in a manner to fit a plurality (all or substantially all) such upper receiver assembly parts typically found in any of the several variants of Conventional AR-15 Type Firearms, without any modification or replacement of such parts. Referring now to FIG. 16 (which shows a DI Buffered BCG 26 typically found in an upper receiver assembly of an AR-15 Type Firearm that uses a DI gas system), and FIG. 18 (which shows an example of an AR-15 Type Firearm that uses a Piston-Driven BCG 26P, and FIG. 19 (which shows an example of an AR-15 Type Firearm that uses a Bufferless Upper Receiver Assembly and Bufferless BCGs 26B housed therein), one of ordinary skill in the art will recognize significant difference in design of such BCGs and the novelty and difficulty in designing a bullpup conversion method that can accommodate and operate with all such BCGs.

Referring now to FIGS. 20, 22, 26, 30, 32, 34, 36, and 38, one of ordinary skill in the art will recognize the several different types and styles of handguards typically found on AR-15 Type Firearms in circulation today (e.g., A2 delta ring, free-float quadrail, free-float low profile, etc.) and further recognize that the preferred embodiment AR-15 Bullpup Lower Receiver Assembly is universally applicable and compatible with all or substantially all AR-15 Type Firearms regardless of which type of handguard is employed on the upper receiver assembly thereof.

Referring now to FIG. 20 (which illustrates examples of some delta ring handguards (generally having two parts 29T/29B), and also examples of some free-floating handguards 29FF, which are but two of the several different styles and shapes of handguards typically found in the upper receiver assemblies of AR-15 Type Firearms). Referring now to FIGS. 23-28 and FIGS. 31-38 (which shows the use of the present disclosure in the preferred embodiment PE1 with upper receiver assemblies having a variety of different handguards of size, shape and style), one of ordinary skill in the art will further recognize that the preferred embodiments of the present disclosure applicable to AR-15 Type Firearms are designed in a manner to be universally applicable to a wide array of upper receiver assemblies regardless of the which type, size, or style of the handguard is employed therein. All known AR-15 Bullpup Conversion Kits are limited to upper receiver assemblies having a specific type and size handguard and are not otherwise universally applicable to all or substantially all such handguards commonly employed on AR-15 Type.

Referring now to FIGS. 14 and 16, which show an exemplary DI Buffered BCG 26 and other component parts of an upper receiver assembly typically found in an AR-15 Type Firearm 20CU. This illustration is provided for background to identify the component parts of an upper receiver assembly of an AR-15 Type Firearm employing a gas-piston system and reference is made thereto to illustrate the fact that the preferred embodiment AR-15 Bullpup Lower Receiver Assembly can be used with an AR-15 Type Firearm upper receiver assembly that employs a gas-piston system.

One of ordinary skill in the art will recognize that none of the AR-15 Bullpup Conversion Kits known in the art are universally applicable to the vast majority of AR-15 Type Firearms in circulation, regardless of the features of the upper receiver assembly and lower receiver assembly thereof. Unlike the preferred embodiment of the present disclosure, all of the AR-15 Bullpup Conversion Kits known in the art are designed to be used with a specific type of lower receiver on the host AR-15 Type Firearm and a specific type and size of handguard or other component in the upper receiver assembly of the host AR-15 Type Firearm. Because bullpup conversion kits are added to a firearm's lower receiver and the exterior shape and contour of AR-15 lower receivers can vary widely, even among those manufactured to are "Mil-spec" standards, these bullpup conversion kits are not universally applicable to many conventionally configured AR-15 firearms. Similarly, the handguard type, shape and size of the handguards found on the upper receiver assemblies of AR-15 type firearms can vary widely and bullpup conversion kits are not designed to universally fit all such handguards.

Finally, beyond the drawings and detailed descriptions provided herein, one of ordinary skill in the art will recognize that the present disclosure is highly likely to function as described herein. The fact of the matter is that the utility and functionality of the present disclosure have been thoroughly vetted and verified with thorough extensive testing. The present disclosure was initially conceived of by the above-referenced inventor approximately four years prior to the filing of this provisional patent application, an initial design prototype model was constructed approximately six months thereafter. After initial testing of this first prototype model, the inventor thereafter incorporated certain modifications into the initial functional prototype to improve both functionality and design aesthetics; however, from a utility standpoint, the original conception of the present disclosure remained unchanged. At all times since the original conception of the present disclosure, strict confidentiality of the present disclosure has been maintained and at no time since original conception has the present disclosure been published or otherwise disclosed to the public in any manner. Commencing on about April of 2020, a functional prototype of PE1 (Functional Prototype) was assembled and through testing of its operation with a variety of AR-15 Type Firearm upper receiver assemblies was commenced. Thereafter, a few thousand rounds of live ammunition of several different calibers have been fired using the Functional Prototype and it has otherwise been objectively extensively tested to evaluate and validate its functional operation. The results of such testing have proven the reliable function and stated utility features of the present disclosure.

While the invention in the present disclosure has been illustrated and described in detail herein in connection with only a limited number of embodiments, it should be readily understood that the invention is not limited to such disclosed embodiments. The foregoing illustrations, description of embodiments and examples provided herein have been presented for purposes of illustration and that such description is only illustrative of the present disclosure, and that while certain forms of this invention have been illustrated and described, is not intended, and should not be construed to be exhaustive or limited thereto except insofar as such limitations are included in the following claims and allowable functional equivalents thereof. Numerous modifications are possible considering the above teachings. In addition, many suitable sizes and shapes or types of elements or materials could be used. The invention can be modified by those skilled in the art to incorporate any number of variations, alterations, substitutions, or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description but is only limited by the scope of the appended claims.

What is claimed is:

1. A method of converting a rifle assembly to a bull-pup configuration, comprising:

a lower receiver;

interlocking a lower receiver bull-pup interface having a pistol grip and trigger guard to an upper receiver assembly of a firearm, the lower receiver bull-pup interface having a forward end, a rear end, and a channel therebetween for accepting the upper receiver assembly, the rear end of the bull-pup interface having opposing upperwardly facing hook portions configured to overlap pivot pin apertures of the lower receiver and to accept a pivot pin;

coupling a trigger relocation assembly between a trigger of the lower receiver and a trigger of the bull-pup interface; and interfacing a recoil buffer and recoil spring of the lower receiver to the firearm.

2. The method of claim 1 wherein the lower receiver houses a fire control unit.

3. The method of claim 1 wherein the lower receiver further comprises an ammunition magazine well.

4. The method of claim 1 wherein the lower receiver further comprises captured receiver pins.

5. The method of claim 1 wherein the trigger relocation assembly comprises a levered trigger linkage system.

6. The method of claim 1 wherein the trigger relocation assembly activates a levered trigger.

7. The method of claim 1 wherein the trigger relocation assembly activates a levered trigger in a fire control unit.

8. A method of converting a rifle assembly to a bull-pup configuration, comprising:

a lower receiver housing a fire control unit and having an ammunition magazine well;

interlocking a lower receiver bull-pup interface having a pistol grip and trigger guard to an upper receiver assembly of a firearm, the lower receiver bull-pup interface having a forward end, a rear end, and a channel therebetween for accepting the upper receiver assembly, the rear end of the bull-pup interface having opposing upperwardly facing hook portions configured to overlap pivot pin apertures of the lower receiver and to accept a pivot pin;

coupling a trigger relocation assembly between a trigger of the lower receiver and a trigger of the bull-pup interface; and interfacing a recoil buffer and recoil spring of the lower receiver to the firearm.

9. The method of claim 8 wherein the lower receiver further comprises captured receiver pins.

10. The method of claim 8 wherein the trigger relocation assembly comprises a levered trigger linkage system.

11. The method of claim 8 wherein the trigger relocation assembly activates a levered trigger.

12. The method of claim 8 wherein the trigger relocation assembly activates a levered trigger in a fire control unit.

13. A method of converting a rifle assembly to a bull-pup configuration, comprising:

a lower receiver housing a fire control unit and having captured receiver pins;

interlocking a lower receiver bull-pup interface having a pistol grip and trigger guard to an upper receiver assembly of a firearm, the lower receiver bull-pup interface having a forward end, a rear end, and a channel therebetween for accepting the upper receiver assembly, the rear end of the bull-pup interface having opposing upperwardly facing hook portions configured to overlap pivot pin apertures of the lower receiver and to accept a pivot pin;

coupling a trigger relocation assembly between a trigger of the lower receiver and a trigger of the bull-pup interface; and interfacing a recoil buffer and recoil spring of the lower receiver to the firearm.

14. The method of claim 13 wherein the lower receiver has an ammunition magazine well.

15. The method of claim 13 wherein the lower receiver further comprises an ammunition magazine well.

16. The method of claim 13 wherein the trigger relocation assembly comprises a levered trigger linkage system.

17. The method of claim 13 wherein the trigger relocation assembly activates a levered trigger.

18. The method of claim 13 wherein the trigger relocation assembly activates a levered trigger in a fire control unit.

* * * * *